US011829170B2

(12) United States Patent
Poulton et al.

(10) Patent No.: US 11,829,170 B2
(45) Date of Patent: Nov. 28, 2023

(54) LOW-POWER DYNAMIC OFFSET CALIBRATION OF AN ERROR AMPLIFIER

(71) Applicant: NVIDIA Corporation, Santa Clara, CA (US)

(72) Inventors: John W. Poulton, Chapel Hill, NC (US); Sudhir Shrikantha Kudva, Dublin, CA (US); John Michael Wilson, Wake Forest, NC (US)

(73) Assignee: NVIDIA Corporation, Santa Clara, CA (US)

( * ) Notice: Subject to any disclaimer, the term of this patent is extended or adjusted under 35 U.S.C. 154(b) by 199 days.

(21) Appl. No.: 17/523,358

(22) Filed: Nov. 10, 2021

(65) Prior Publication Data

US 2023/0145487 A1 May 11, 2023

(51) Int. Cl.
*G05F 1/46* (2006.01)

(52) U.S. Cl.
CPC ..... *G05F 1/461* (2013.01); *G05F 1/468* (2013.01)

(58) Field of Classification Search
CPC ..... G05F 1/461; G05F 1/468
See application file for complete search history.

(56) References Cited

U.S. PATENT DOCUMENTS 10,601,409 B2 3/2020 Poulton et al.
2019/0079552 A1* 3/2019 Yasusaka ..... G05F 1/461
2019/0146532 A1* 5/2019 Ballarin ..... G05F 1/462 323/283
2019/0384337 A1* 12/2019 Lu ..... G05F 1/575
2022/0011796 A1* 1/2022 Yasusaka ..... G05F 1/461

OTHER PUBLICATIONS

Kudva, S., et al., "A Switching Linear Regulator Based on a Fast-Self-Clocked Comparator with Very Low Probability of Metastability and a Parallel Analog Ripple Control Module," IEEE 2018, 4 pp.

* cited by examiner

*Primary Examiner* — Jue Zhang
*Assistant Examiner* — Lakaisha Jackson
(74) *Attorney, Agent, or Firm* — Leydig, Voit & Mayer, Ltd.

(57) ABSTRACT

Systems and methods are disclosed related to low-power dynamic offset calibration of an error amplifier. An analog linear voltage regulator circuit tracks changes between a reference voltage and a regulated voltage to keep the regulated voltage as close as possible to the reference voltage. The analog linear voltage regulator includes an error amplifier that measures the error between the reference and regulated voltages and feedback circuitry. The error amplifier and feedback circuitry should be calibrated to correct for any offset within the circuits. The described offset calibration technique not only compensates for the offset in the error amplifier but also cancels any mismatch in the feedback network. During operation, conditions such as temperature and supply voltage may vary causing the offset to change. The technique is low power and dynamically cancels the offset even when the linear regulator is operating to supply the desired voltage.

20 Claims, 11 Drawing Sheets

LOW-POWER DYNAMIC OFFSET CALIBRATION OF AN ERROR AMPLIFIER

BACKGROUND

An analog linear voltage regulator circuit tracks changes between a reference voltage and a regulated voltage to keep the regulated voltage as close as possible to the reference voltage. The analog linear voltage regulator includes an error amplifier that measures the error between the reference and regulated voltages and feedback circuitry. The error amplifier and feedback circuitry should be calibrated to correct for any offset within the circuits that may cause inaccurate error measurements and tracking of the analog linear voltage regulator. Conventional calibration techniques typically calibrate the error amplifier in isolation and do not calibrate the feedback circuitry. There is a need for addressing these issues and/or other issues associated with the prior art.

SUMMARY

Embodiments of the present disclosure relate to low-power dynamic offset calibration of an error amplifier. Systems and methods are disclosed related to low-power dynamic offset calibration of an error amplifier within an analog linear voltage regulator. The analog linear voltage regulator circuit tracks changes between a reference voltage and a regulated voltage to keep the regulated voltage as close as possible to the reference voltage. The analog linear voltage regulator provides fast-response regulation when fabricated within integrated circuits. The analog linear voltage regulator includes feedback circuitry, a comparator, and the error amplifier that measures and reduces the error between the reference and regulated voltages. The calibration technique corrects for any offset within the circuits, not only compensating for the offset in the error amplifier but also canceling any mismatch in the feedback network and comparator. The offset and/or mismatches may be caused by variations in the fabrication process used to create the analog linear voltage regulator circuit components. In contrast, conventional calibration techniques typically calibrate the error amplifier in isolation and do not calibrate the comparator and/or feedback circuitry.

During operation, conditions such as temperature and supply voltage may vary causing the offset to change. The calibration technique is low power and dynamically cancels the offset even when the analog linear voltage regulator is operating to supply the desired voltage. In contrast, conventional calibration techniques typically calibrate the error amplifier at initialization and do not repeat the calibration during operation.

In an embodiment, the method for calibrating a linear voltage regulator includes coupling a first input of a comparator circuit to a second input of the comparator circuit and adjusting a first offset input to the comparator circuit based on an output of the comparator circuit to cancel a first voltage offset associated with the first input and the second input. The first input is coupled from the second input and a reference voltage is coupled to the first input, a regulated voltage is coupled to the second input and operating the comparator circuit according to the first offset to generate a difference signal at the output, and based on the difference signal, a second offset input to an error amplifier circuit having a second voltage offset associated with a third input and a fourth input is adjusted to cancel the second voltage offset while the error amplifier circuit generates a current control signal to adjust the regulated voltage at a load.

In an embodiment, linear voltage regulator comprises an error amplifier circuit having a first voltage offset associated with a first input and a second input and a comparator circuit having a second voltage offset associated with a third input and a fourth input. The error amplifier circuit generates a current control signal to adjust a regulated voltage at a load while reducing differences between a reference voltage at the first input and the regulated voltage at the second input according to an offset cancellation input. The comparator circuit generates the offset cancellation input according to a calibration of the first voltage offset and a calibration of the second voltage offset.

In an embodiment, a linear voltage regulator comprises a transistor coupled between a power supply and a load to generate a regulated voltage at the load controlled by a current control signal at a gate of the transistor, an error amplifier circuit having a first voltage offset associated with a first input and a second input, and a comparator circuit. The error amplifier circuit generates the current control signal, according to an offset cancellation input, to reduce differences between a reference voltage at the first input and the regulated voltage at the second input. The comparator circuit determines a second voltage offset when a third input and a fourth input to the comparator circuit are coupled together and adjusts the offset cancellation input to cancel the first voltage offset when the third input is coupled to the reference voltage and the fourth input is coupled to the regulated voltage.

BRIEF DESCRIPTION OF THE DRAWINGS

The present systems and methods related to low-power dynamic offset calibration of an error amplifier are described in detail below with reference to the attached drawing figures, wherein.

DETAILED DESCRIPTION

Systems and methods are disclosed related to low-power dynamic offset calibration of an error amplifier. An analog linear voltage regulator circuit tracks changes between a reference voltage and a regulated voltage to keep the regulated voltage as close as possible to the reference voltage. The analog linear voltage regulator includes feedback circuitry and an error amplifier that measures the error between the reference and regulated voltages. The feedback circuitry may comprise switches, a comparator, and other logic. To ensure that the measurements are accurate for high performance tracking, the error amplifier and feedback circuitry is calibrated to correct for any offset within the circuits. Conventional calibration techniques typically calibrate the error amplifier in isolation and do not calibrate the feedback circuitry.

The offset cancellation technique may be performed not only at initialization, but also during operation without disabling or disconnecting the error amplifier. Therefore, high performance voltage regulation is maintained even when operating conditions such as temperature and supply voltage vary. Furthermore, the calibration technique is low power to avoid degrading efficiency of the analog linear voltage regulator.

Figure 1A:
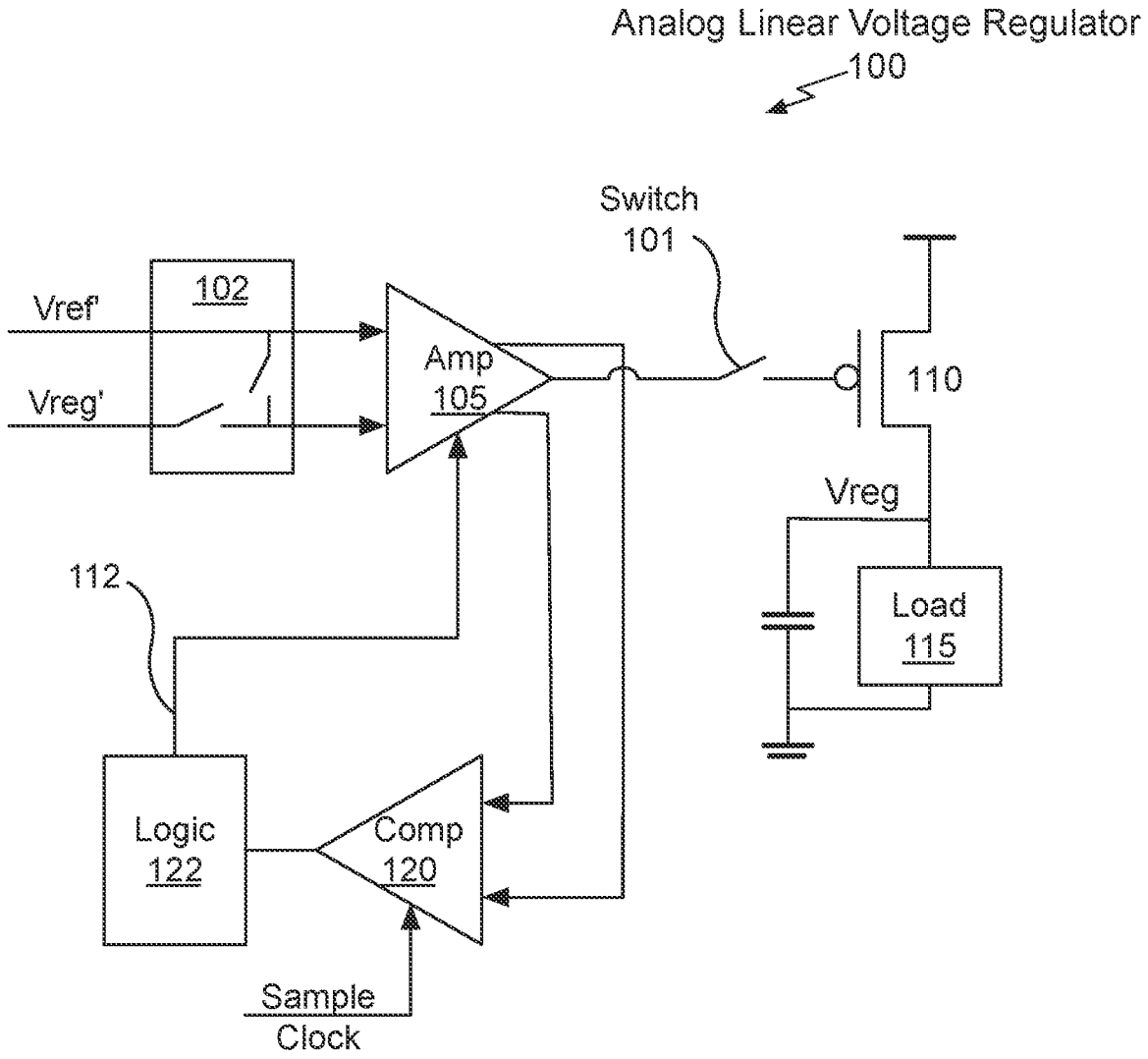
(PRIOR ART) Fig. 1A
FIG. 1A illustrates a block diagram of a prior art analog linear voltage regulator.

FIG. 1A illustrates a block diagram of a prior art analog linear voltage regulator 100. The prior art analog linear voltage regulator 100 includes an error amplifier 105 that compares a scaled version of reference voltage (Vref') with a scaled regulated voltage (Vreg') to generate a gate control signal of a PMOS (p-channel metal oxide semiconductor) power device 110. The PMOS power device 110 is coupled between a power supply and a load 115 to provide a regulated voltage (Vreg). An error between the regulated voltage and the reference voltage is determined by an input referred offset between Vref' and Vreg' that are coupled by switches 102 to the two input terminals of the error amplifier 102. During operation, a switch 101 is closed to couple a gate control signal at the output of the error amplifier 105 to the gate of the PMOS power device 110.

Conventionally, offset in the error amplifier 105 is cancelled by opening the switch 101 to disconnect the output of the error amplifier 105 from the gate of the PMOS power device 110 and configuring the switches 102 to short the two input terminals of the error amplifier 105 together and decouple the input terminals from Vreg'. Additionally, the single-ended error amplifier 105 is configured to differential form and differential output signals input to a digital comparator 120 are compared. The digital comparator 120 samples the inputs using a sample clock. If there is no voltage offset between the two input terminals of the error amplifier 105, then the differential output signals are close together and, when sampled by the digital comparator 120, an equal number of ones and zeros will be received by logic 122. If there is a voltage offset between the two input terminals of the error amplifier 105, then a higher number of either zeros or ones will be received by the logic 122 and a signal 112 may be adjusted until an equal number of ones and zeros is received.

A disadvantage of the conventional analog linear voltage regulator 100 is that the circuit structure used during regulation operation is different from the circuit structure that is used during offset calibration. Specifically, the switches 101 and 102 change the connections of the input and output terminals of the error amplifier 105 and the error amplifier 105 is changed between a differential and single-ended output mode. Mismatches in the digital comparator 120 and other circuitry used during the offset calibration that is not also included in the circuit structure for regulation operation may introduce an error between the regulated and reference voltages.

Additionally, changes in temperature and input supply voltage during regulation operation may cause the offset to vary and calibration to be lost. To prevent errors due to operating conditions, the error amplifier 105 needs to periodically offset calibrated which requires turning off or disabling the analog linear voltage regulator 100. Turning off the analog linear voltage regulator 100 may not be acceptable for certain applications, so that dynamic calibration during operation is not possible.

The main purpose of voltage offset cancellation is to achieve a regulated voltage (Vreg) which closely tracks the reference voltage (Vref). The disadvantages of the conventional analog linear voltage regulator 100 may be resolved by using a circuit that maintains a consistent structure for regulation operation and calibration. A digital clocked comparator may compare the regulated and reference voltages and dynamically adjust an offset control code of the analog error amplifier while an analog linear voltage regulator is actively regulating the voltage.

Figure 1B:
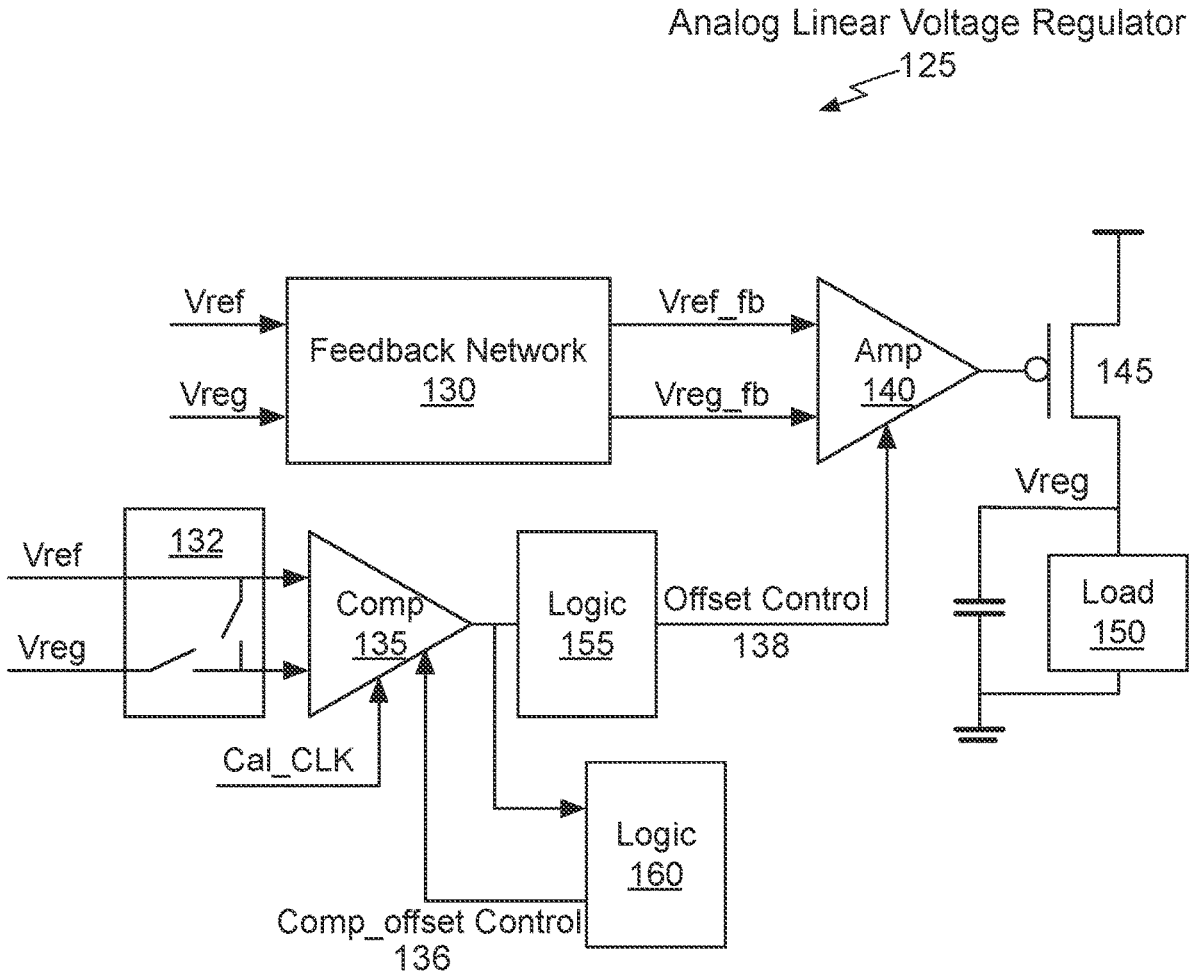
FIG. 1B illustrates a block diagram of an example analog linear voltage regulator suitable for use in implementing some embodiments of the present disclosure.

FIG. 1B illustrates a block diagram of an example analog linear voltage regulator 125 suitable for use in implementing some embodiments of the present disclosure. It should be understood that this and other arrangements described herein are set forth only as examples. Other arrangements and elements (e.g., circuit components, machines, interfaces, functions, orders, groupings of functions, etc.) may be used in addition to or instead of those shown, and some elements may be omitted altogether. Further, many of the elements described herein are functional entities that may be implemented as discrete or distributed components or in conjunction with other components, and in any suitable combination and location. Various functions described herein as being performed by entities may be carried out by hardware, firmware, and/or software. For instance, various functions may be carried out by a processor executing instructions stored in memory. Furthermore, persons of ordinary skill in the art will understand that any system that performs the operations of the analog linear voltage regulator 125 is within the scope and spirit of embodiments of the present disclosure.

As shown in FIG. 1B, the analog linear voltage regulator 125 includes an error amplifier 140 and a digital comparator 135. The error amplifier 140 generates a voltage control signal that is output to a gate of a PMOS power device 145. The PMOS power device 145 is coupled between a power supply and a load 150 to provide a regulated voltage (Vreg). The error amplifier 140 adjusts an output (e.g., current control signal) that is coupled to the gate. The current control signal is generated to reduce differences between Vref_fb and Vreg_fb that are coupled to the input terminals of the error amplifier 140. The inputs Vref_fb and Vreg_fb may be scaled versions of Vref and Vreg, respectively. In an embodiment, a feedback network 130 is omitted and the inputs Vref_fb and Vreg_fb equal Vref and Vreg, respectively.

The analog linear voltage regulator 125 also includes logic 155, logic 160, and switches 132. An offset control 138 cancels a first offset between the input terminals of the error amplifier 140 and a comp_offset control 136 cancels a second offset between the input terminals of the digital comparator 135. The digital comparator 135 is used to calibrate and cancel both the first offset and the second offset.

The digital comparator 135 is clocked by a calibration clock (Cal_CLK) that may operate at a very low clock frequency consuming a low amount of power. The Cal_CLK is used to sample an output of the digital comparator 135. If there is no voltage offset between the two input terminals of the digital comparator 135 that are sampled during a time duration, an equal number of ones and zeros will be received by the logic 160. A zero (e.g., logic low level) corresponds with a sample when a first one of the input terminals is higher compared with a second one of the input terminals and a one (e.g., logic high level) corresponds with a sample when the second input terminal is higher compared with the first input terminal. Even when the two input terminals are coupled to the same signal (e.g., Vreg) an offset may result from mismatches between devices (e.g., transistors, capacitors, etc.) within the digital comparator 135. If there is an offset between the two input terminals of the digital comparator 135, then a higher number of either logic low levels or logic high levels will be received by the logic 160 and the comp_offset control 136 may be adjusted until an equal number of logic high and low levels are received over a time duration, effectively cancelling the second offset.

In the context of the following description, the process of adjusting the comp_offset control 136 to cancel the second offset is referred to as calibration of the second offset or the digital comparator 135. In an embodiment, during calibration of the digital comparator 135, the switches 132 couple the two input terminals of the digital comparator 135 together to input Vref to both input terminals and the logic 160 adjusts comp_offset control 136 to cancel the second offset. Comp_offset control 136 may be adjusted to calibrate the digital comparator 135 while the analog linear voltage regulator 125 is operating using a fixed offset control 138 value. In an embodiment, during calibration of the digital comparator 135 to cancel the second offset, the logic 155 may hold the offset control 138 at a value used before calibration of the digital comparator 135 is initiated. Equalizing the logic high and low levels corresponds to detecting equal values at the input terminals of the digital comparator 135 and the calibrated value of comp_offset control 136 cancels the second offset.

After the second offset associated with the digital comparator 135 is cancelled, and the switches 132 are configured so that the digital comparator 135 receives Vref and Vreg at the input terminals and the logic 160 holds comp_offset control 136 at the value determined to cancel the second offset. With the second offset cancelled, the digital comparator 135 output accurately measures differences between Vref and Vreg. In contrast, any offset associated with the error amplifier 140 that is not canceled interferes with the ability of the error amplifier 140 to generate a gate control signal that will accurately regulate Vreg. After the digital comparator 135 is calibrated and the second offset is cancelled, the digital comparator 135 may then be used to calibrate the error amplifier 140 to accurately measure and cancel the first offset. In the context of the following description, the process of adjusting the offset control 138 to cancel the first offset is referred to as calibration of the first offset or the error amplifier 140.

Calibration of the error amplifier 140 is performed by coupling Vref and Vreg to the input terminals of the digital comparator 135 while the logic 155 adjusts the offset control 138 until a number of logic high and low levels at the output of the digital comparator 135 are equal, effectively cancelling the first offset of the error amplifier 140. In an embodiment, the offset control 138 may be adjusted continuously to respond to changing operating conditions while continuing to regulate Vreg. Furthermore, calibration of the digital comparator 135 by adjusting comp_offset control 136 may be repeated during operation of the analog linear voltage regulator 140 without disabling regulation operation. The digital comparator 135 and the logic 160 may be configured in a sleep mode when calibration is complete and/or between calibrations.

More illustrative information will now be set forth regarding various optional architectures and features with which the foregoing framework may be implemented, per the desires of the user. It should be strongly noted that the following information is set forth for illustrative purposes and should not be construed as limiting in any manner. Any of the following features may be optionally incorporated with or without the exclusion of other features described.

Figure 1C:
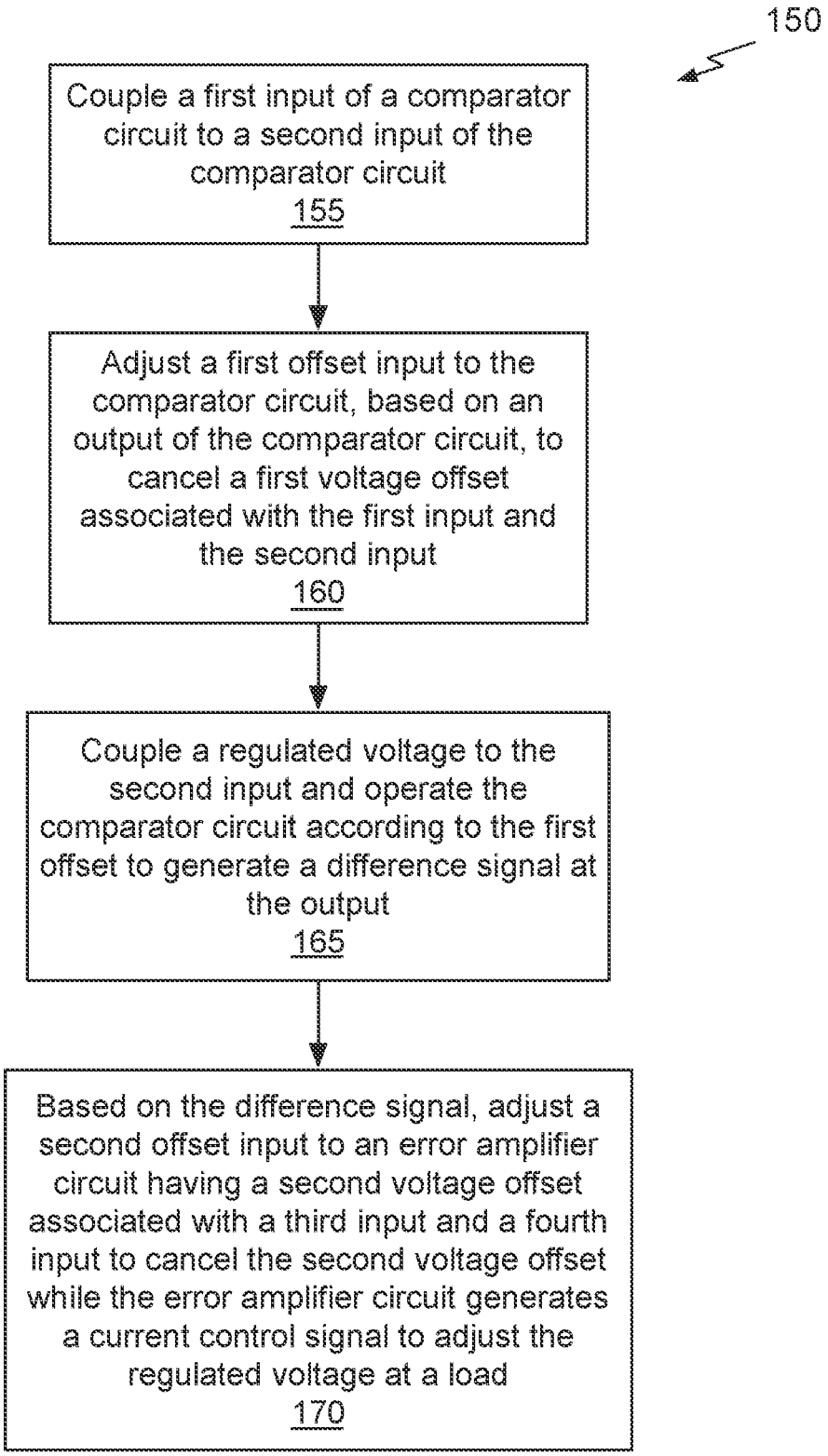
FIG. 1C illustrates a flowchart of a method for calibrating a linear voltage regulator, in accordance with an embodiment.

FIG. 1C illustrates a flowchart of a method 150 for method for calibrating a linear voltage regulator, in accordance with an embodiment. Each block of method 150, described herein, comprises a computing process that may be performed using any combination of hardware, firmware, and/or software. For instance, various functions may be carried out by a processor executing instructions stored in memory. The method may also be embodied as computer-usable instructions stored on computer storage media. The method may be provided by a standalone application, a service or hosted service (standalone or in combination with another hosted service), or a plug-in to another product, to name a few. In addition, method 150 is described, by way of example, with respect to the analog linear voltage regulator 125 of FIG. 1B. However, this method may additionally or alternatively be executed by any one system, or any combination of systems, including, but not limited to, those described herein. Furthermore, persons of ordinary skill in the art will understand that any system that performs method 150 is within the scope and spirit of embodiments of the present disclosure.

At step 155, a first input of a comparator circuit is coupled to a second input of the comparator circuit. In an embodiment, the two input terminals of the comparator circuit 135 are both coupled to Vref. At step 160, a first offset input to the comparator circuit is adjusted based on an output of the comparator circuit to cancel a first voltage offset associated with the first input and the second input. In an embodiment, adjusting the first offset input comprises equalizing a count of high logic levels and low logic levels at the output of the comparator circuit. In an embodiment, the comp_offset control 136 is adjusted by the logic 155 based on the output of the digital comparator 135. In an embodiment, a value of the comp_offset control 136 is determined for which the output produces an equal number of logic high and logic low levels over a time duration. In an embodiment, setting the comp_offset control 136 to the value results in cancellation of the first voltage offset.

At step 165, a regulated voltage is coupled to the second input and the comparator circuit is operated according to the first offset to generate a difference signal at the output. In an embodiment, the second input is decoupled from the first input of the comparator circuit when the regulated voltage is coupled to the second input. In an embodiment, the difference signal provides a measurement of a voltage offset of the error amplifier 140.

At step 170, based on the difference signal, a second offset input to an error amplifier circuit is adjusted. The error amplifier circuit has a second voltage offset associated with a third input and a fourth input and the second offset input is adjusted to cancel the second voltage offset while the error amplifier circuit generates a current control signal to adjust the regulated voltage at a load. In an embodiment, the error amplifier circuit comprises the error amplifier 140. In an embodiment, the error amplifier circuit generates the current control signal to reduce differences between the reference voltage at the third input and the regulated voltage at the fourth input. In an embodiment, the error amplifier 140 continues to regulate the voltage Vreg at the load while the second voltage offset is calibrated. In an embodiment, the adjusting of the first offset input and the adjusting of the second offset input are repeated while the error amplifier circuit generates the current control signal. In an embodiment, adjusting of at least one of the first offset input or the second offset input is performed periodically at fixed or variable time durations while the error amplifier circuit generates the current control signal. In an embodiment, adjusting of at least one of the first offset input or the second offset input is performed in response to changes in operating conditions (e.g., temperature, supply voltage).

In an embodiment, adjusting the second offset input comprises equalizing a count of high logic levels and low logic levels at the output of the comparator circuit. In an embodiment, the logic 155 adjusts the offset control 138 to cancel the second voltage offset. In an embodiment, the reference voltage is scaled to provide a scaled reference voltage at the third input and the regulated voltage is scaled to provide a scaled regulated voltage at the fourth input. In an embodiment, the feedback network 130 scales Vref and Vreg to provide Vreg_fb and Vreg_fb at the input terminals of the error amplifier 140.

Figure 2:
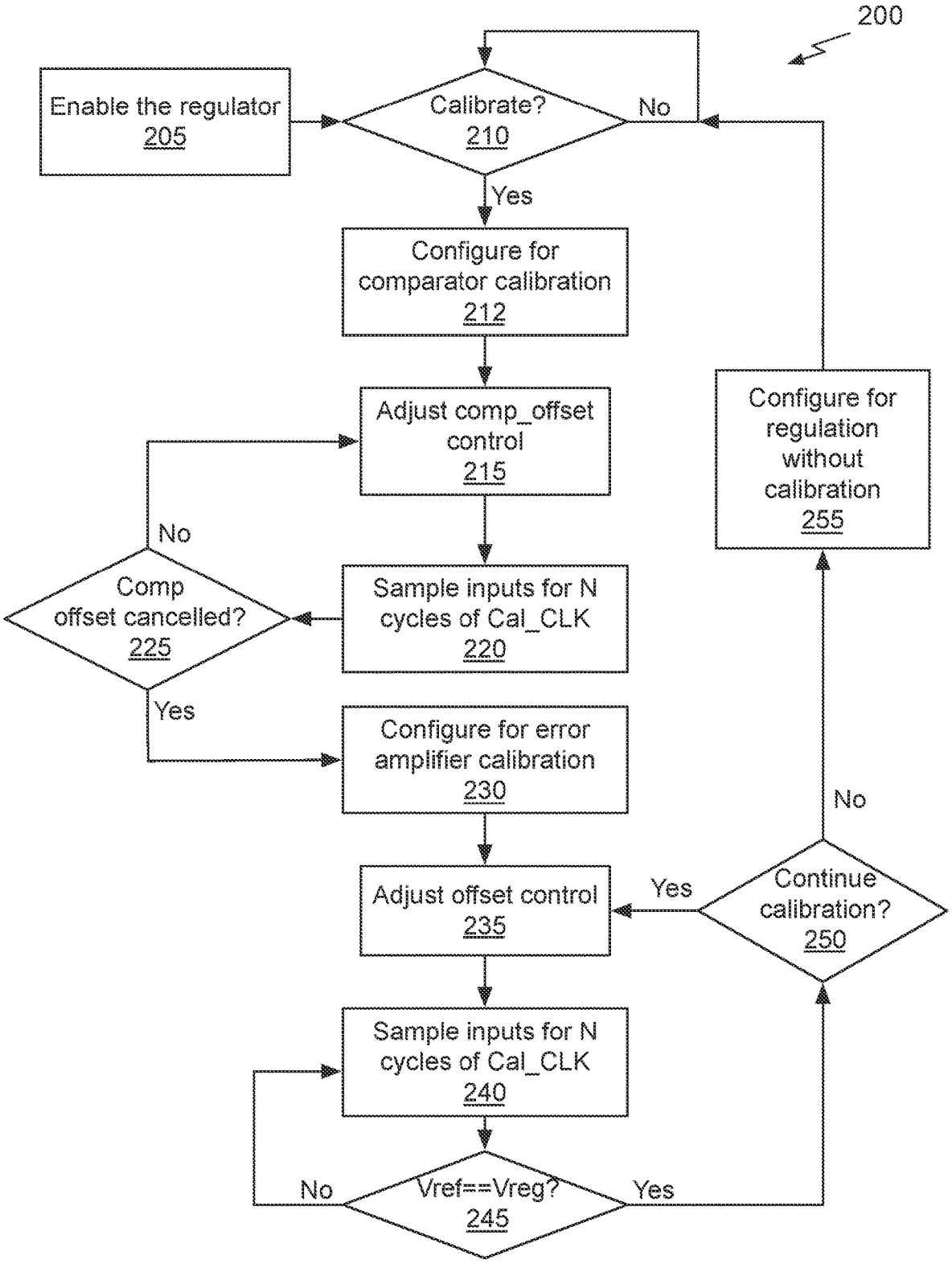
FIG. 2 illustrates another flowchart of a method for calibrating a linear voltage regulator, in accordance with an embodiment.

FIG. 2 illustrates another flowchart of a method 200 for calibrating a linear voltage regulator, in accordance with an embodiment. Each block of method 200, described herein, comprises a computing process that may be performed using any combination of hardware, firmware, and/or software. For instance, various functions may be carried out by a processor executing instructions stored in memory. The method may also be embodied as computer-usable instructions stored on computer storage media. The method may be provided by a standalone application, a service or hosted service (standalone or in combination with another hosted service), or a plug-in to another product, to name a few. In addition, method 200 is described, by way of example, with respect to the analog linear voltage regulator 125 of FIG. 1B. However, this method may additionally or alternatively be executed by any one system, or any combination of systems, including, but not limited to, those described herein. Furthermore, persons of ordinary skill in the art will understand that any system that performs method 200 is within the scope and spirit of embodiments of the present disclosure.

At step 205, the analog linear voltage regulator 125 is enabled to begin regulation of the voltage Vreg at the load 150. At step 210, the method determines whether the calibration process should be initiated, and, of not, the method repeats step 210. Otherwise, at step 212 calibration is initiated by configuring the digital comparator 135 for calibration. In an embodiment, the configuring comprises coupling both input terminals of the digital comparator 135 to Vref by the switches 132, enabling the calibration clock (cal_CLK) and the logic 160, and holding the offset control 138 at a fixed value.

At step 215, comp_offset control 136 is adjusted based on the output of the digital comparator 135 to calibrate the digital comparator 135. In an embodiment, the comp_offset control 136 is initialized to a value associated with a voltage offset of zero. In another embodiment, the comp_offset control 136 is initialized to the value determined during a previous calibration.

At step 220, the inputs to the digital comparator 135 (both coupled to Vreg) are sampled for N cycles of cal_CLK. At step 225, the method determines if adjusted value of the comp_offset control 136 cancels the voltage offset of the digital comparator 135. If the voltage offset is not cancelled, then the method returns to step 215. Otherwise, at step 230, the analog linear voltage regulator 125 is configured for calibration of the error amplifier 140. In an embodiment, the configuring comprises decoupling one of input terminals of the digital comparator 135 from Vreg and coupling the input terminal to Vreg by the switches 132, enabling the calibration clock (cal_CLK) and the logic 160, and holding the comp offset control 136 at a fixed value. Notably, connections to inputs and outputs from the error amplifier 140 remain unmodified during calibration of both the digital comparator 135 and the error amplifier 140. The connections to and from the error amplifier 140 may be maintained for both calibration and for regulation operation. In other words, the structure of the circuitry is consistent for calibration and operation.

At step 235, offset control 138 is adjusted by the logic 155 based on the output of the digital comparator 135 to calibrate the error amplifier 140. In an embodiment, the offset control 138 is initialized to a value associated with a voltage offset of zero. In another embodiment, the offset control 138 is initialized to the value determined during a previous calibration.

At step 240, the inputs to the digital comparator 135 (separately coupled to Vref and Vreg) are sampled for N cycles of cal_CLK. At step 245, the method determines if the adjusted value of the offset control 138 cancels the voltage offset of the error amplifier 140. In an embodiment, the voltage offset of the error amplifier 140 is determined to be cancelled when the digital comparator 135 and the logic 155 indicate that the inputs Vef and Vreg are equal. If, at step 245, the voltage offset is not cancelled, then the method returns to step 240. Otherwise, at step 250, the method determines if calibration of the error amplifier 140 will continue. In an embodiment, calibration may continue if the operating conditions are changing which, in turn, may cause changes in the voltage offset.

If, at step 250, the method determines that calibration will continue, then the method returns to step 235. Otherwise, at step 255, the analog linear voltage regulator 125 is configured for voltage regulation without dynamic calibration of the error amplifier 140. In an embodiment, the configuring comprises disabling the calibration clock (cal_CLK) and holding the offset control 138 at a fixed value.

Figure 3A:
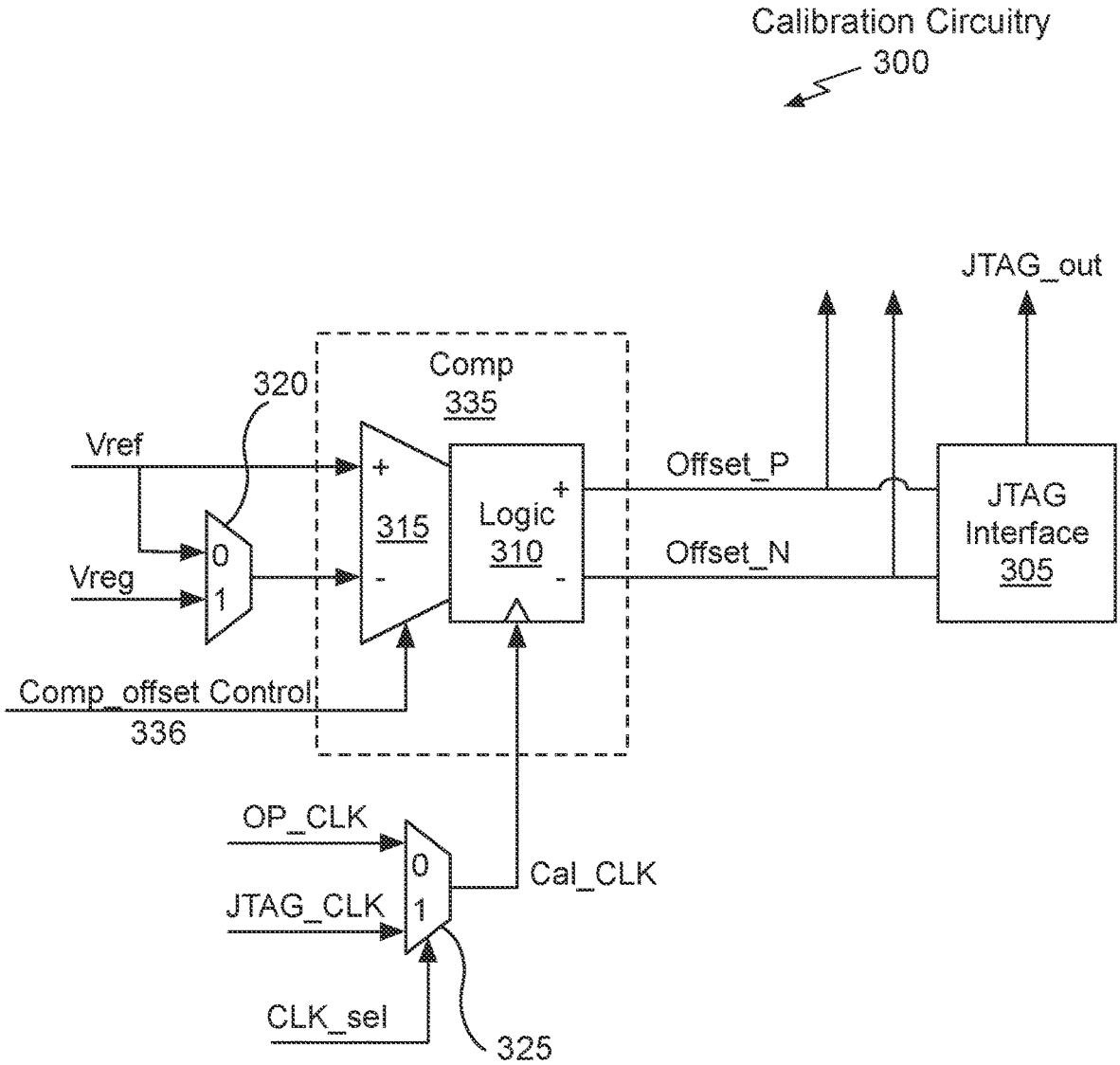
FIG. 3A illustrates a block diagram of calibration circuitry suitable for use in implementing some embodiments of the present disclosure.

FIG. 3A illustrates a block diagram of calibration circuitry 300 suitable for use in implementing some embodiments of the present disclosure. Instead of relying on circuitry, such as the logic 160 to calibrate a digital comparator 335, the calibration is performed by software through a joint test action group (JTAG) interface 305. In an embodiment, as illustrated in FIG. 3A, the digital comparator 335 performs the function of the digital comparator 135 with a differential output instead of a single-ended output. The digital comparator 335 comprises a comparator 315 with a first and second input terminal and logic 310. The comparator 315 compares the inputs and outputs either a logic high or low level depending on which input has a higher voltage level. The switches 132 of the analog linear voltage regulator 125 shown in FIG. 1B are implemented as a multiplexer 320 that selects Vref for the digital comparator 335 while the digital comparator 335 is being calibrated and selects Vreg otherwise.

The logic 310 samples the output of the comparator 315 according to the cal_CLK and outputs differential outputs offset_P and offset_N. A logic high level corresponds to offset_P being asserted and offset_N being negated. A logic low level corresponds to offset_N being asserted and offset_P being negated. When the digital comparator 335 is being calibrated, CLK_sel configures a multiplexer 325 to select JTAG_CLK as the cal_CLK. Otherwise, CLK_sel configures the multiplexer 325 to select OP_CLK as the cal_CLK.

The calibration circuitry 300 does not include the logic 160 for adjusting the comp_offset control 136 input to the digital comparator 335. Instead, the differential outputs offset_P and offset_N are received by a JTAG interface 305 and output as JTAG_out by the integrated circuit within which the calibration circuitry 300 is fabricated, for evaluation by software. The number of high and low logic levels received at JTAG_out may be counted over a time duration and a comp_offset control 336 may be adjusted to cancel the voltage offset of the digital comparator 335. Performing the calibration through the JTAG interface 305 is slower compared with using logic on the integrated circuit to count the high and low logic levels and adjust the comp_offset control 336. However, if speed is not necessary for the calibration process, the JTAG interface 305 consumes less die area compared with implementing additional logic on the integrated circuit.

Figure 3B:
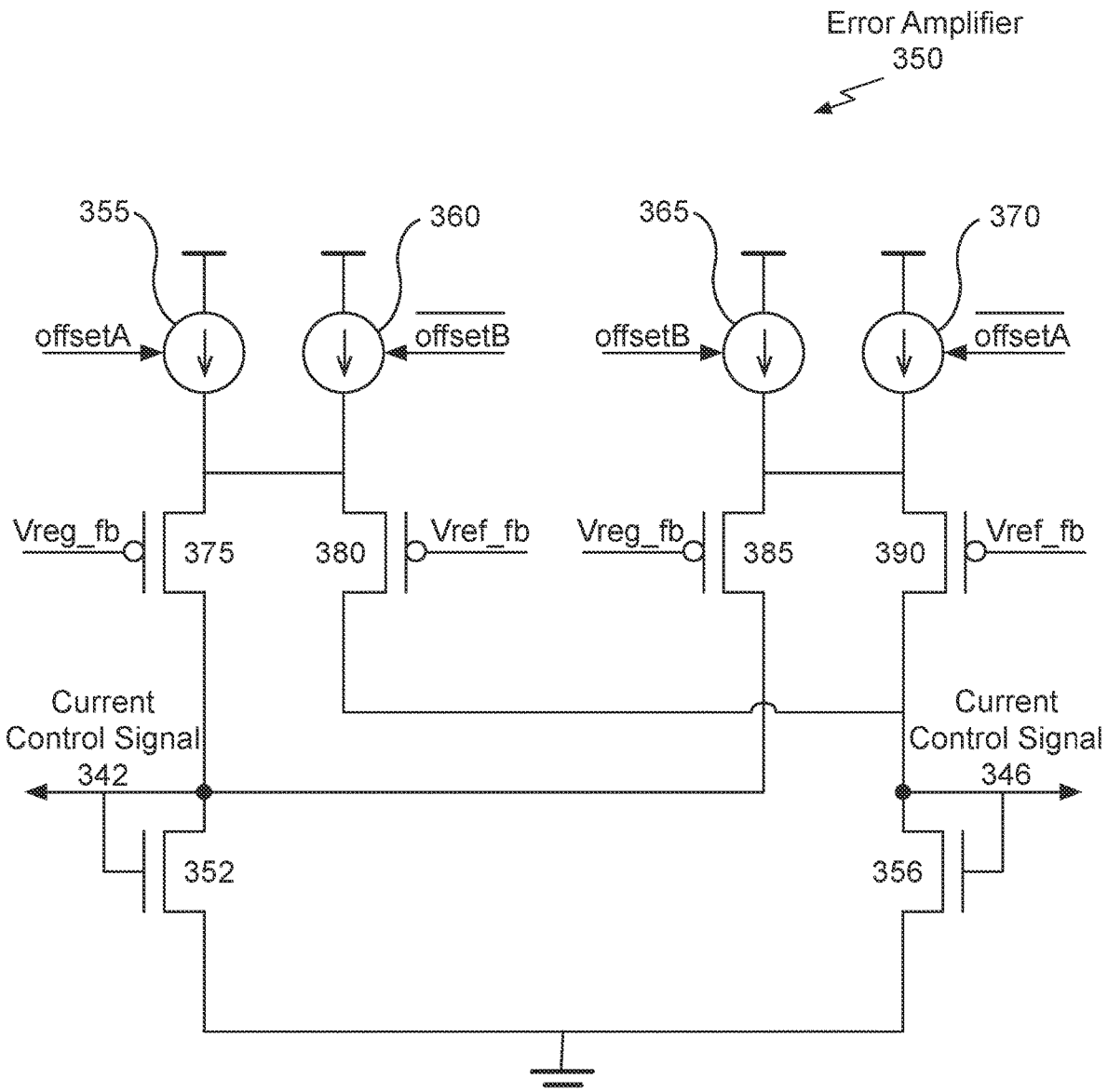
FIG. 3B illustrates an example circuit diagram of an error amplifier suitable for use in implementing some embodiments of the present disclosure.

FIG. 3B illustrates an example circuit diagram of an analog error amplifier 350 suitable for use in implementing some embodiments of the present disclosure. Rather than providing a single-ended current control signal like the error amplifier 140, the analog error amplifier 350 provides a differential output control signal comprising control signals 342 and 346. Similarly, the single-ended offset control 138 for the error amplifier 140 is replaced with the differential offset controls, offsetA and offsetB.

The offsetA controls a current source 355, an inverted offset controls a current source 360, the offset controls a current source 365, and an inverted offsetA controls a current source 370. Programming each of the current sources 355, 360, 365, and 370 can be achieved by configuring a current source transistor in series with a switch transistor that is controlled by the digital signals offsetA, inverted offsetB, offset, and inverted offsetA, respectively. The digital signals offsetA, inverted offsetB, offset, and inverted offsetA may be generated by logic within an integrated circuit or provided from a JTAG register. To increase the current, more segments of the current source transistors are enabled and, conversely, to decrease the current segments of the current source transistors are disabled. The offsetA and offsetB signals perform current steering for voltage offset cancelling. When the current is reduced in one of the branches, current is being proportionally increased in the other branch to keep the total bias current of the first stage of the analog error amplifier 350. This ensures that the bandwidth is not impacted by voltage offset cancellation.

The transistors 352 and 356 are configured as diode connected loads for high bandwidth. In an embodiment, the transistors 352 and 356 are replaced with current source-based loads. In another embodiment, the transistors 352 and 356 are replaced with resistor-based load if the fabrication process provides for high quality resistors. The control signals 342 and 346 may be coupled to a second stage differential input to a single ended amplifier if more gain is required. The transistors 375, 380, 385, and 390 are PMOS devices when the input voltage levels are close to the low power supply (e.g., GND). In another embodiment, NMOS (n-channel metal oxide semiconductor) devices are used when the input signals are closer to the high power supply (e.g., VDD).

Figure 4:
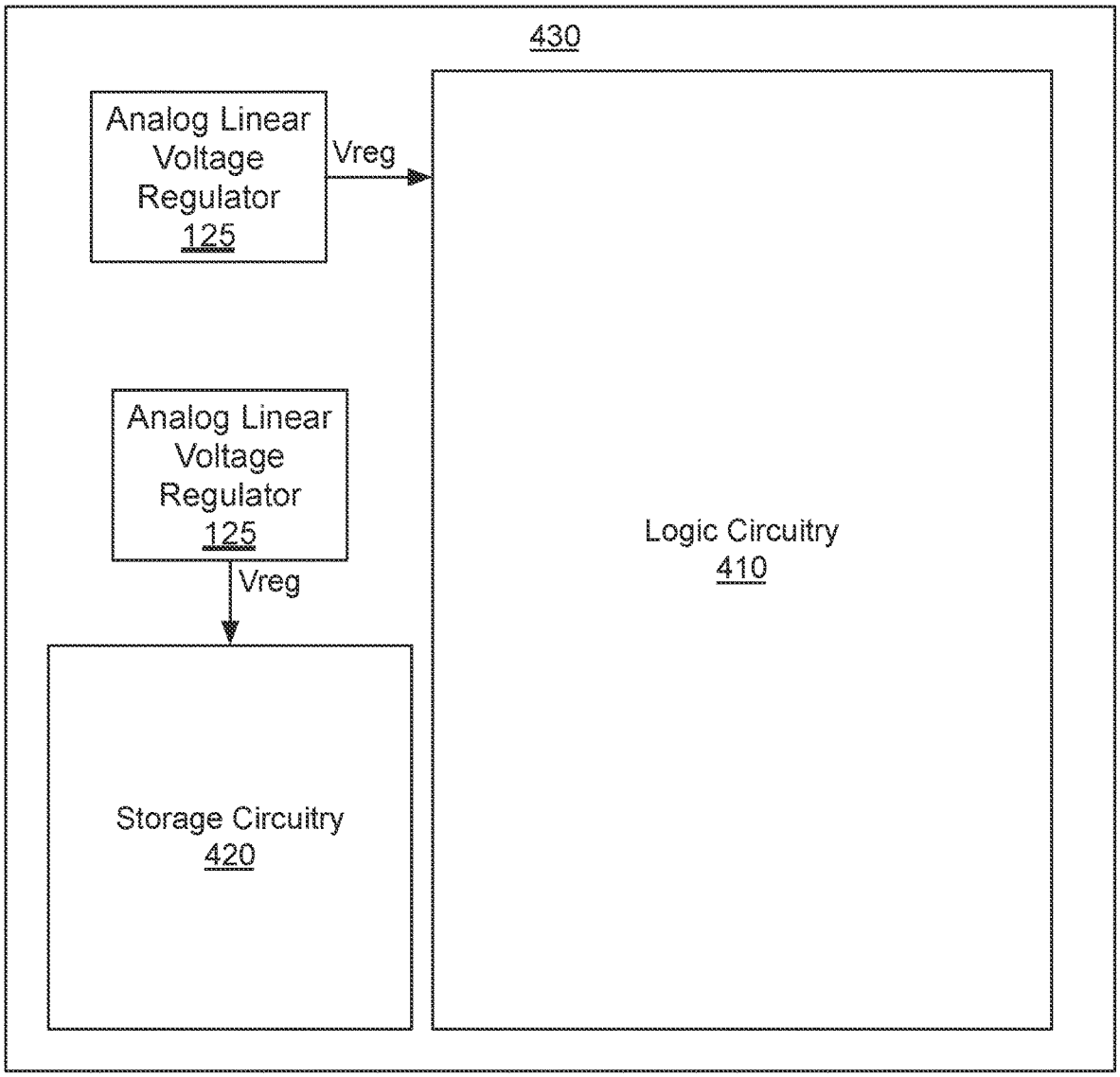
FIG. 4 illustrates a conceptual diagram of multiple analog linear voltage regulators fabricated in a silicon die suitable for use in implementing some embodiments of the present disclosure.

FIG. 4A illustrates a conceptual diagram of multiple analog linear voltage regulators 125 fabricated in a silicon die 430 suitable for use in implementing some embodiments of the present disclosure. The analog linear voltage regulator 125 provides fast-response regulation when fabricated within integrated circuits. The integrated circuit silicon die 430 also includes logic circuitry 410 and/or storage circuitry 420. In other embodiments, additional circuitry may be fabricated in the silicon die 430. A first analog linear voltage regulator 125 provides a first regulated voltage Vreg to the logic circuitry 410 and a second analog linear voltage regulator 125 provides a second regulated voltage Vreg to the storage circuitry 420.

The voltage offset cancellation technique calibrates and cancels the first voltage offset of the error amplifier offset without interrupting voltage regulator operation and also calibrates and cancels the second voltage offset of the digital comparator. The calibration process may be repeated in response to changes in operating conditions (e.g., temperature and/or the supply voltage) that affect the voltage offsets. No reconfiguration of the error amplifier circuitry (or inputs) is needed to for either offset calibration or cancellation of the error amplifier circuitry. Therefore, disadvantages of the conventional techniques are resolved by using a circuit that maintains a consistent structure for regulation operation and calibration.

Exemplary Computing System

Systems with multiple GPUs and CPUs are used in a variety of industries as developers expose and leverage more parallelism in applications such as artificial intelligence computing. High-performance GPU-accelerated systems with tens to many thousands of compute nodes are deployed in data centers, research facilities, and supercomputers to solve ever larger problems. As the number of processing devices within the high-performance systems increases, the communication and data transfer mechanisms need to scale to support the increased bandwidth.

Figure 5A:
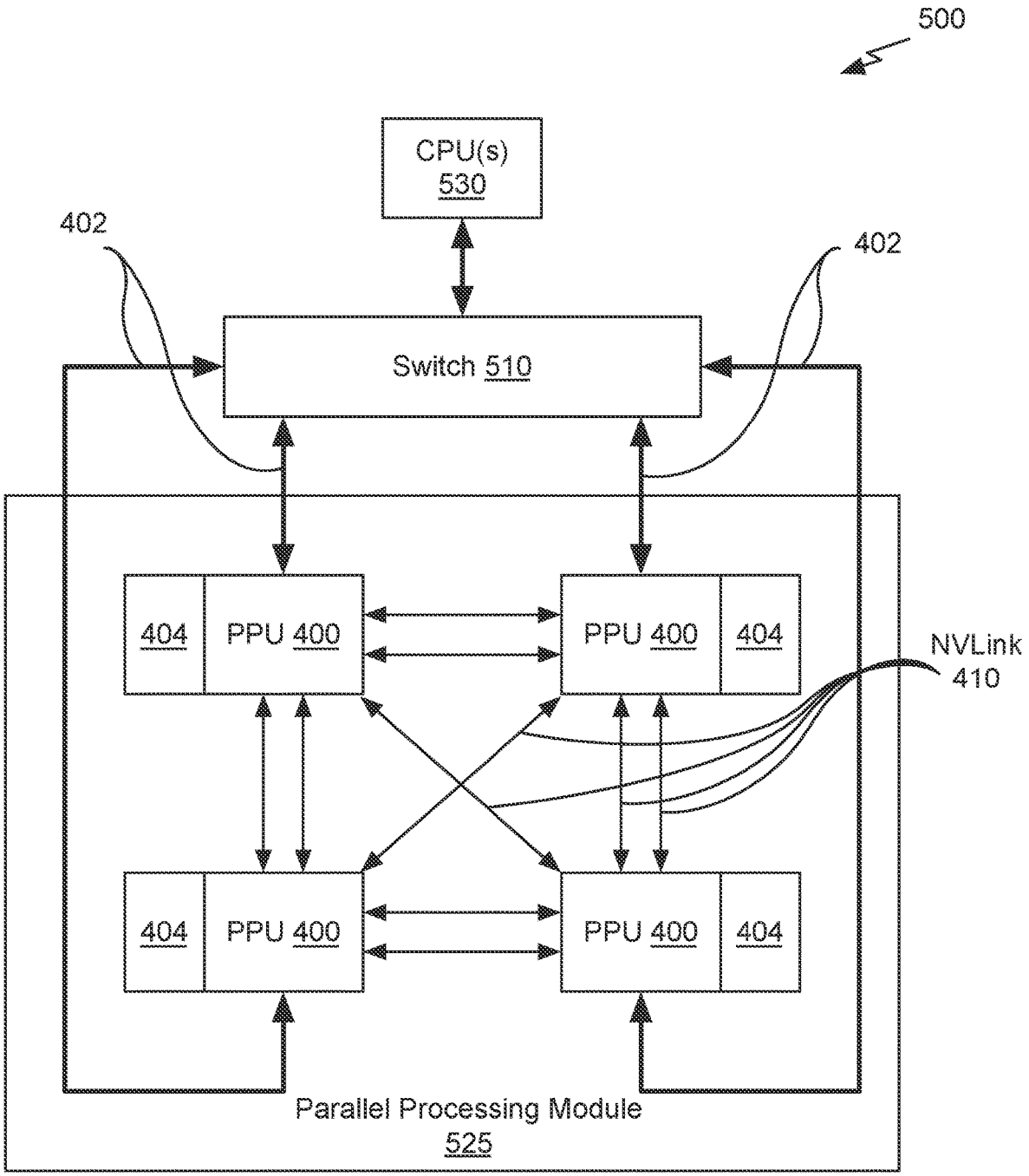
FIG. 5A is a conceptual diagram of a processing system in which the various architecture and/or functionality of the various previous embodiments may be implemented.

FIG. 5A is a conceptual diagram of a processing system 500, in accordance with an embodiment. The exemplary system 500 may be configured to implement the method 150 shown in FIG. 1C and/or the method 200 shown in FIG. 2. The processing system 500 includes a CPU 530, switch 510, and multiple parallel processing units (PPUs) 400, and respective memories 404. The exemplary system 500 may be implemented in a silicon die that also includes a one or more analog linear voltage regulators 125.

Each PPU 400 may include hundreds or thousands of cores that are capable of handling hundreds or thousands of software threads simultaneously. The PPUs 400 may generate pixel data for output images in response to rendering commands (e.g., rendering commands from the CPU(s) 530 received via a host interface). The PPUs 400 may include graphics memory, such as display memory, for storing pixel data or any other suitable data, such as GPGPU data. The display memory may be included as part of the memory 404. The PPUs 400 may include two or more GPUs operating in parallel (e.g., via a link). The link may directly connect the GPUs (e.g., using NVLINK 410) or may connect the GPUs through a switch (e.g., using switch 510). When combined together, each PPU 400 may generate pixel data or GPGPU data for different portions of an output or for different outputs (e.g., a first PPU for a first image and a second PPU for a second image). Each PPU 400 may include its own memory 404, or may share memory with other PPUs 400.

The PPUs 400 may each include, and/or be configured to perform functions of, one or more processing cores and/or components thereof, such as Tensor Cores (TCs), Tensor Processing Units (TPUs), Pixel Visual Cores (PVCs), Vision Processing Units (VPUs), Graphics Processing Clusters (GPCs), Texture Processing Clusters (TPCs), Streaming Multiprocessors (SMs), Tree Traversal Units (TTUs), Artificial Intelligence Accelerators (AIAs), Deep Learning Accelerators (DLAs), Arithmetic-Logic Units (ALUs), Application-Specific Integrated Circuits (ASICs), Floating Point Units (FPUs), input/output (I/O) elements, peripheral component interconnect (PCI) or peripheral component interconnect express (PCIe) elements, and/or the like.

Figure 5B:
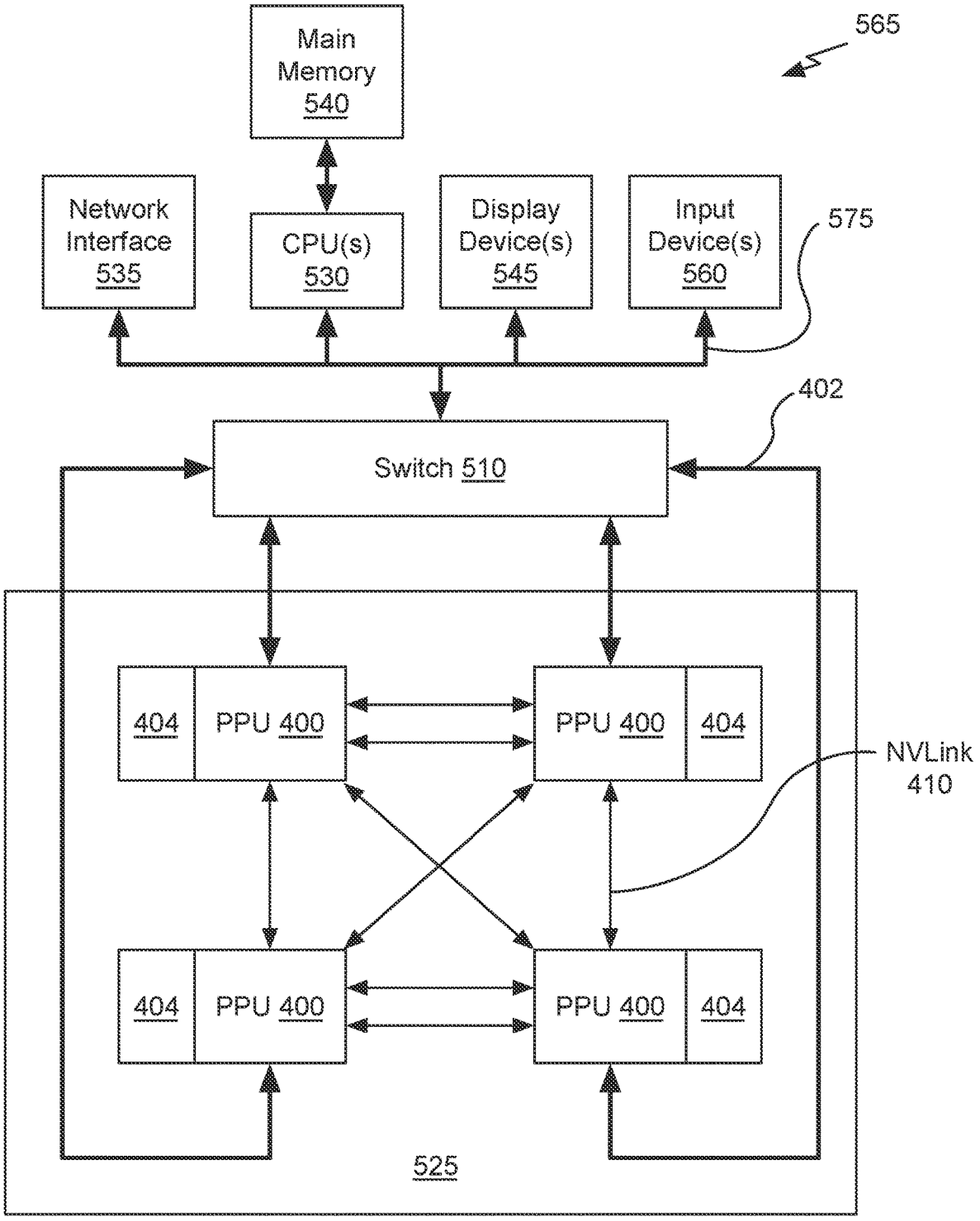
FIG. 5B illustrates an exemplary system in which the various architecture and/or functionality of the various previous embodiments may be implemented.

The NVLink 410 provides high-speed communication links between each of the PPUs 400. Although a particular number of NVLink 410 and interconnect 402 connections are illustrated in FIG. 5B, the number of connections to each PPU 400 and the CPU 530 may vary. The switch 510 interfaces between the interconnect 402 and the CPU 530. The PPUs 400, memories 404, and NVLinks 410 may be situated on a single semiconductor platform to form a parallel processing module 525. In an embodiment, the switch 510 supports two or more protocols to interface between various different connections and/or links.

In another embodiment (not shown), the NVLink 410 provides one or more high-speed communication links between each of the PPUs 400 and the CPU 530 and the switch 510 interfaces between the interconnect 402 and each of the PPUs 400. The PPUs 400, memories 404, and interconnect 402 may be situated on a single semiconductor platform to form a parallel processing module 525. In yet another embodiment (not shown), the interconnect 402 provides one or more communication links between each of the PPUs 400 and the CPU 530 and the switch 510 interfaces between each of the PPUs 400 using the NVLink 410 to provide one or more high-speed communication links between the PPUs 400. In another embodiment (not shown), the NVLink 410 provides one or more high-speed communication links between the PPUs 400 and the CPU 530 through the switch 510. In yet another embodiment (not shown), the interconnect 402 provides one or more communication links between each of the PPUs 400 directly. One or more of the NVLink 410 high-speed communication links may be implemented as a physical NVLink interconnect or either an on-chip or on-die interconnect using the same protocol as the NVLink 410.

In the context of the present description, a single semiconductor platform may refer to a sole unitary semiconductor-based integrated circuit fabricated on a die or chip. It should be noted that the term single semiconductor platform may also refer to multi-chip modules with increased connectivity which simulate on-chip operation and make substantial improvements over utilizing a conventional bus implementation. Of course, the various circuits or devices may also be situated separately or in various combinations of semiconductor platforms per the desires of the user. Alternately, the parallel processing module 525 may be implemented as a circuit board substrate and each of the PPUs 400 and/or memories 404 may be packaged devices. In an embodiment, the CPU 530, switch 510, and the parallel processing module 525 are situated on a single semiconductor platform.

In an embodiment, the signaling rate of each NVLink 410 is 20 to 25 Gigabits/second and each PPU 400 includes six NVLink 410 interfaces (as shown in FIG. 5A, five NVLink 410 interfaces are included for each PPU 400). Each NVLink 410 provides a data transfer rate of 25 Gigabytes/second in each direction, with six links providing 400 Gigabytes/second. The NVLinks 410 can be used exclusively for PPU-to-PPU communication as shown in FIG. 5A, or some combination of PPU-to-PPU and PPU-to-CPU, when the CPU 530 also includes one or more NVLink 410 interfaces.

In an embodiment, the NVLink 410 allows direct load/store/atomic access from the CPU 530 to each PPU's 400 memory 404. In an embodiment, the NVLink 410 supports coherency operations, allowing data read from the memories 404 to be stored in the cache hierarchy of the CPU 530, reducing cache access latency for the CPU 530. In an embodiment, the NVLink 410 includes support for Address Translation Services (ATS), allowing the PPU 400 to directly access page tables within the CPU 530. One or more of the NVLinks 410 may also be configured to operate in a low-power mode.

FIG. 5B illustrates an exemplary system 565 in which the various architecture and/or functionality of the various previous embodiments may be implemented. The exemplary system 565 may be configured to implement the method 150 shown in FIG. 1C and/or the method 200 shown in FIG. 2.

As shown, a system 565 is provided including at least one central processing unit 530 that is connected to a communication bus 575. The communication bus 575 may directly or indirectly couple one or more of the following devices: main memory 540, network interface 535, CPU(s) 530, display device(s) 545, input device(s) 560, switch 510, and parallel processing system 525. The communication bus 575 may be implemented using any suitable protocol and may represent one or more links or busses, such as an address bus, a data bus, a control bus, or a combination thereof. The communication bus 575 may include one or more bus or link types, such as an industry standard architecture (ISA) bus, an extended industry standard architecture (EISA) bus, a video electronics standards association (VESA) bus, a peripheral component interconnect (PCI) bus, a peripheral component interconnect express (PCIe) bus, HyperTransport, and/or another type of bus or link. In some embodiments, there are direct connections between components. As an example, the CPU(s) 530 may be directly connected to the main memory 540. Further, the CPU(s) 530 may be directly connected to the parallel processing system 525. Where there is direct, or point-to-point connection between components, the communication bus 575 may include a PCIe link to carry out the connection. In these examples, a PCI bus need not be included in the system 565.

Although the various blocks of FIG. 5B are shown as connected via the communication bus 575 with lines, this is not intended to be limiting and is for clarity only. For example, in some embodiments, a presentation component, such as display device(s) 545, may be considered an I/O component, such as input device(s) 560 (e.g., if the display is a touch screen). As another example, the CPU(s) 530 and/or parallel processing system 525 may include memory (e.g., the main memory 540 may be representative of a storage device in addition to the parallel processing system 525, the CPUs 530, and/or other components). In other words, the computing device of FIG. 5B is merely illustrative. Distinction is not made between such categories as "workstation," "server," "laptop," "desktop," "tablet," "client device," "mobile device," "hand-held device," "game console," "electronic control unit (ECU)," "virtual reality system," and/or other device or system types, as all are contemplated within the scope of the computing device of FIG. 5B.

The system 565 also includes a main memory 540. Control logic (software) and data are stored in the main memory 540 which may take the form of a variety of computer-readable media. The computer-readable media may be any available media that may be accessed by the system 565. The computer-readable media may include both volatile and nonvolatile media, and removable and non-removable media. By way of example, and not limitation, the computer-readable media may comprise computer-storage media and communication media.

The computer-storage media may include both volatile and nonvolatile media and/or removable and non-removable media implemented in any method or technology for storage of information such as computer-readable instructions, data structures, program modules, and/or other data types. For example, the main memory 540 may store computer-readable instructions (e.g., that represent a program(s) and/or a program element(s), such as an operating system. Computer-storage media may include, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which may be used to store the desired information and which may be accessed by system 565. As used herein, computer storage media does not comprise signals per se.

The computer storage media may embody computer-readable instructions, data structures, program modules, and/or other data types in a modulated data signal such as a carrier wave or other transport mechanism and includes any information delivery media. The term "modulated data signal" may refer to a signal that has one or more of its characteristics set or changed in such a manner as to encode information in the signal. By way of example, and not limitation, the computer storage media may include wired media such as a wired network or direct-wired connection, and wireless media such as acoustic, RF, infrared and other wireless media. Combinations of any of the above should also be included within the scope of computer-readable media.

Computer programs, when executed, enable the system 565 to perform various functions. The CPU(s) 530 may be configured to execute at least some of the computer-readable instructions to control one or more components of the system 565 to perform one or more of the methods and/or processes described herein. The CPU(s) 530 may each include one or more cores (e.g., one, two, four, eight, twenty-eight, seventy-two, etc.) that are capable of handling a multitude of software threads simultaneously. The CPU(s) 530 may include any type of processor, and may include different types of processors depending on the type of system 565 implemented (e.g., processors with fewer cores for mobile devices and processors with more cores for servers). For example, depending on the type of system 565, the processor may be an Advanced RISC Machines (ARM) processor implemented using Reduced Instruction Set Computing (RISC) or an x86 processor implemented using Complex Instruction Set Computing (CISC). The system 565 may include one or more CPUs 530 in addition to one or more microprocessors or supplementary co-processors, such as math co-processors.

In addition to or alternatively from the CPU(s) 530, the parallel processing module 525 may be configured to execute at least some of the computer-readable instructions to control one or more components of the system 565 to perform one or more of the methods and/or processes described herein. The parallel processing module 525 may be used by the system 565 to render graphics (e.g., 3D graphics) or perform general purpose computations. For example, the parallel processing module 525 may be used for General-Purpose computing on GPUs (GPGPU). In embodiments, the CPU(s) 530 and/or the parallel processing module 525 may discretely or jointly perform any combination of the methods, processes and/or portions thereof.

The system 565 also includes input device(s) 560, the parallel processing system 525, and display device(s) 545. The display device(s) 545 may include a display (e.g., a monitor, a touch screen, a television screen, a heads-up-display (HUD), other display types, or a combination thereof), speakers, and/or other presentation components. The display device(s) 545 may receive data from other components (e.g., the parallel processing system 525, the CPU(s) 530, etc.), and output the data (e.g., as an image, video, sound, etc.).

The network interface 535 may enable the system 565 to be logically coupled to other devices including the input devices 560, the display device(s) 545, and/or other components, some of which may be built in to (e.g., integrated in) the system 565. Illustrative input devices 560 include a microphone, mouse, keyboard, joystick, game pad, game controller, satellite dish, scanner, printer, wireless device, etc. The input devices 560 may provide a natural user interface (NUI) that processes air gestures, voice, or other physiological inputs generated by a user. In some instances, inputs may be transmitted to an appropriate network element for further processing. An NUI may implement any combination of speech recognition, stylus recognition, facial recognition, biometric recognition, gesture recognition both on screen and adjacent to the screen, air gestures, head and eye tracking, and touch recognition (as described in more detail below) associated with a display of the system 565. The system 565 may be include depth cameras, such as stereoscopic camera systems, infrared camera systems, RGB camera systems, touchscreen technology, and combinations of these, for gesture detection and recognition. Additionally, the system 565 may include accelerometers or gyroscopes (e.g., as part of an inertia measurement unit (IMU)) that enable detection of motion. In some examples, the output of the accelerometers or gyroscopes may be used by the system 565 to render immersive augmented reality or virtual reality.

Further, the system 565 may be coupled to a network (e.g., a telecommunications network, local area network (LAN), wireless network, wide area network (WAN) such as the Internet, peer-to-peer network, cable network, or the like) through a network interface 535 for communication purposes. The system 565 may be included within a distributed network and/or cloud computing environment.

The network interface 535 may include one or more receivers, transmitters, and/or transceivers that enable the system 565 to communicate with other computing devices via an electronic communication network, included wired and/or wireless communications. The network interface 535 may be implemented as a network interface controller (NIC) that includes one or more data processing units (DPUs) to perform operations such as (for example and without limitation) packet parsing and accelerating network processing and communication. The network interface 535 may include components and functionality to enable communication over any of a number of different networks, such as wireless networks (e.g., Wi-Fi, Z-Wave, Bluetooth, Bluetooth LE, ZigBee, etc.), wired networks (e.g., communicating over Ethernet or InfiniBand), low-power wide-area networks (e.g., LoRaWAN, SigFox, etc.), and/or the Internet.

The system 565 may also include a secondary storage (not shown). The secondary storage includes, for example, a hard disk drive and/or a removable storage drive, representing a floppy disk drive, a magnetic tape drive, a compact disk drive, digital versatile disk (DVD) drive, recording device, universal serial bus (USB) flash memory. The removable storage drive reads from and/or writes to a removable storage unit in a well-known manner. The system 565 may also include a hard-wired power supply, a battery power supply, or a combination thereof (not shown). The power supply may provide power to the system 565 to enable the components of the system 565 to operate.

Each of the foregoing modules and/or devices may even be situated on a single semiconductor platform to form the system 565. Alternately, the various modules may also be situated separately or in various combinations of semiconductor platforms per the desires of the user. While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

Example Network Environments

Network environments suitable for use in implementing embodiments of the disclosure may include one or more client devices, servers, network attached storage (NAS), other backend devices, and/or other device types. The client devices, servers, and/or other device types (e.g., each device) may be implemented on one or more instances of the processing system 500 of FIG. 5A and/or exemplary system 565 of FIG. 5B—e.g., each device may include similar components, features, and/or functionality of the processing system 500 and/or exemplary system 565.

Components of a network environment may communicate with each other via a network(s), which may be wired, wireless, or both. The network may include multiple networks, or a network of networks. By way of example, the network may include one or more Wide Area Networks (WANs), one or more Local Area Networks (LANs), one or more public networks such as the Internet and/or a public switched telephone network (PSTN), and/or one or more private networks. Where the network includes a wireless telecommunications network, components such as a base station, a communications tower, or even access points (as well as other components) may provide wireless connectivity.

Compatible network environments may include one or more peer-to-peer network environments—in which case a server may not be included in a network environment—and one or more client-server network environments—in which case one or more servers may be included in a network environment. In peer-to-peer network environments, functionality described herein with respect to a server(s) may be implemented on any number of client devices.

In at least one embodiment, a network environment may include one or more cloud-based network environments, a distributed computing environment, a combination thereof, etc. A cloud-based network environment may include a framework layer, a job scheduler, a resource manager, and a distributed file system implemented on one or more of servers, which may include one or more core network servers and/or edge servers. A framework layer may include a framework to support software of a software layer and/or one or more application(s) of an application layer. The software or application(s) may respectively include web-based service software or applications. In embodiments, one or more of the client devices may use the web-based service software or applications (e.g., by accessing the service software and/or applications via one or more application programming interfaces (APIs)). The framework layer may be, but is not limited to, a type of free and open-source software web application framework such as that may use a distributed file system for large-scale data processing (e.g., "big data").

A cloud-based network environment may provide cloud computing and/or cloud storage that carries out any combination of computing and/or data storage functions described herein (or one or more portions thereof). Any of these various functions may be distributed over multiple locations from central or core servers (e.g., of one or more data centers that may be distributed across a state, a region, a country, the globe, etc.). If a connection to a user (e.g., a client device) is relatively close to an edge server(s), a core server(s) may designate at least a portion of the functionality to the edge server(s). A cloud-based network environment may be private (e.g., limited to a single organization), may be public (e.g., available to many organizations), and/or a combination thereof (e.g., a hybrid cloud environment).

The client device(s) may include at least some of the components, features, and functionality of the example processing system 500 of FIG. 5A and/or exemplary system 565 of FIG. 5B. By way of example and not limitation, a client device may be embodied as a Personal Computer (PC), a laptop computer, a mobile device, a smartphone, a tablet computer, a smart watch, a wearable computer, a Personal Digital Assistant (PDA), an MP3 player, a virtual reality headset, a Global Positioning System (GPS) or device, a video player, a video camera, a surveillance device or system, a vehicle, a boat, a flying vessel, a virtual machine, a drone, a robot, a handheld communications device, a hospital device, a gaming device or system, an entertainment system, a vehicle computer system, an embedded system controller, a remote control, an appliance, a consumer electronic device, a workstation, an edge device, any combination of these delineated devices, or any other suitable device.

Machine Learning

Deep neural networks (DNNs) developed on processors, such as the PPU 400 have been used for diverse use cases, from self-driving cars to faster drug development, from automatic image captioning in online image databases to smart real-time language translation in video chat applications. Deep learning is a technique that models the neural learning process of the human brain, continually learning, continually getting smarter, and delivering more accurate results more quickly over time. A child is initially taught by an adult to correctly identify and classify various shapes, eventually being able to identify shapes without any coaching. Similarly, a deep learning or neural learning system needs to be trained in object recognition and classification for it get smarter and more efficient at identifying basic objects, occluded objects, etc., while also assigning context to objects.

At the simplest level, neurons in the human brain look at various inputs that are received, importance levels are assigned to each of these inputs, and output is passed on to other neurons to act upon. An artificial neuron or perceptron is the most basic model of a neural network. In one example, a perceptron may receive one or more inputs that represent various features of an object that the perceptron is being trained to recognize and classify, and each of these features is assigned a certain weight based on the importance of that feature in defining the shape of an object.

A deep neural network (DNN) model includes multiple layers of many connected nodes (e.g., perceptrons, Boltzmann machines, radial basis functions, convolutional layers, etc.) that can be trained with enormous amounts of input data to quickly solve complex problems with high accuracy. In one example, a first layer of the DNN model breaks down an input image of an automobile into various sections and looks for basic patterns such as lines and angles. The second layer assembles the lines to look for higher level patterns such as wheels, windshields, and mirrors. The next layer identifies the type of vehicle, and the final few layers generate a label for the input image, identifying the model of a specific automobile brand.

Once the DNN is trained, the DNN can be deployed and used to identify and classify objects or patterns in a process known as inference. Examples of inference (the process through which a DNN extracts useful information from a given input) include identifying handwritten numbers on checks deposited into ATM machines, identifying images of friends in photos, delivering movie recommendations to over fifty million users, identifying and classifying different types of automobiles, pedestrians, and road hazards in driverless cars, or translating human speech in real-time.

During training, data flows through the DNN in a forward propagation phase until a prediction is produced that indicates a label corresponding to the input. If the neural network does not correctly label the input, then errors between the correct label and the predicted label are analyzed, and the weights are adjusted for each feature during a backward propagation phase until the DNN correctly labels the input and other inputs in a training dataset. Training complex neural networks requires massive amounts of parallel computing performance, including floating-point multiplications and additions that are supported by the PPU 400. Inferencing is less compute-intensive than training, being a latency-sensitive process where a trained neural network is applied to new inputs it has not seen before to classify images, detect emotions, identify recommendations, recognize and translate speech, and generally infer new information.

Neural networks rely heavily on matrix math operations, and complex multi-layered networks require tremendous amounts of floating-point performance and bandwidth for both efficiency and speed. With thousands of processing cores, optimized for matrix math operations, and delivering tens to hundreds of TFLOPS of performance, the PPU 400 is a computing platform capable of delivering performance required for deep neural network-based artificial intelligence and machine learning applications.

Furthermore, data generated applying one or more of the techniques disclosed herein may be used to train, test, or certify DNNs used to recognize objects and environments in the real world. Such data may include scenes of roadways, factories, buildings, urban settings, rural settings, humans, animals, and any other physical object or real-world setting. Such data may be used to train, test, or certify DNNs that are employed in machines or robots to manipulate, handle, or modify physical objects in the real world. Furthermore, such data may be used to train, test, or certify DNNs that are employed in autonomous vehicles to navigate and move the vehicles through the real world. Additionally, data generated applying one or more of the techniques disclosed herein may be used to convey information to users of such machines, robots, and vehicles.

Figure 5C:
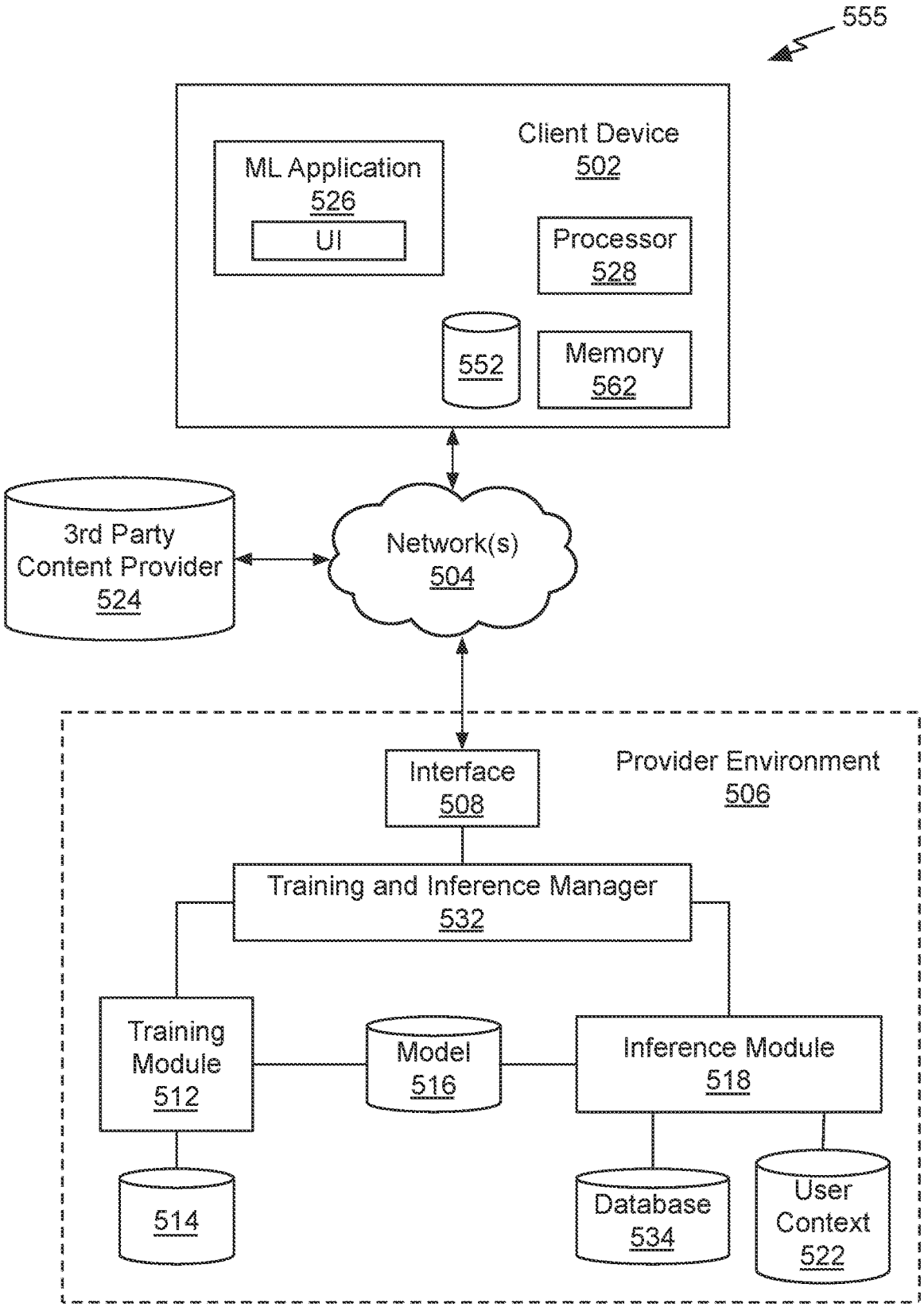
FIG. 5C illustrates components of an exemplary system that can be used to train and utilize machine learning, in at least one embodiment.

FIG. 5C illustrates components of an exemplary system 555 that can be used to train and utilize machine learning, in accordance with at least one embodiment. As will be discussed, various components can be provided by various combinations of computing devices and resources, or a single computing system, which may be under control of a single entity or multiple entities. Further, aspects may be triggered, initiated, or requested by different entities. In at least one embodiment training of a neural network might be instructed by a provider associated with provider environment 506, while in at least one embodiment training might be requested by a customer or other user having access to a provider environment through a client device 502 or other such resource. In at least one embodiment, training data (or data to be analyzed by a trained neural network) can be provided by a provider, a user, or a third party content provider 524. In at least one embodiment, client device 502 may be a vehicle or object that is to be navigated on behalf of a user, for example, which can submit requests and/or receive instructions that assist in navigation of a device.

In at least one embodiment, requests are able to be submitted across at least one network 504 to be received by a provider environment 506. In at least one embodiment, a client device may be any appropriate electronic and/or computing devices enabling a user to generate and send such requests, such as, but not limited to, desktop computers, notebook computers, computer servers, smartphones, tablet computers, gaming consoles (portable or otherwise), computer processors, computing logic, and set-top boxes. Network(s) 504 can include any appropriate network for transmitting a request or other such data, as may include Internet, an intranet, an Ethernet, a cellular network, a local area network (LAN), a wide area network (WAN), a personal area network (PAN), an ad hoc network of direct wireless connections among peers, and so on.

In at least one embodiment, requests can be received at an interface layer 508, which can forward data to a training and inference manager 532, in this example. The training and inference manager 532 can be a system or service including hardware and software for managing requests and service corresponding data or content, in at least one embodiment, the training and inference manager 532 can receive a request to train a neural network, and can provide data for a request to a training module 512. In at least one embodiment, training module 512 can select an appropriate model or neural network to be used, if not specified by the request, and can train a model using relevant training data. In at least one embodiment, training data can be a batch of data stored in a training data repository 514, received from client device 502, or obtained from a third party provider 524. In at least one embodiment, training module 512 can be responsible for training data. A neural network can be any appropriate network, such as a recurrent neural network (RNN) or convolutional neural network (CNN). Once a neural network is trained and successfully evaluated, a trained neural network can be stored in a model repository 516, for example, that may store different models or networks for users, applications, or services, etc. In at least one embodiment, there may be multiple models for a single application or entity, as may be utilized based on a number of different factors.

In at least one embodiment, at a subsequent point in time, a request may be received from client device 502 (or another such device) for content (e.g., path determinations) or data that is at least partially determined or impacted by a trained neural network. This request can include, for example, input data to be processed using a neural network to obtain one or more inferences or other output values, classifications, or predictions, or for at least one embodiment, input data can be received by interface layer 508 and directed to inference module 518, although a different system or service can be used as well. In at least one embodiment, inference module 518 can obtain an appropriate trained network, such as a trained deep neural network (DNN) as discussed herein, from model repository 516 if not already stored locally to inference module 518. Inference module 518 can provide data as input to a trained network, which can then generate one or more inferences as output. This may include, for example, a classification of an instance of input data. In at least one embodiment, inferences can then be transmitted to client device 502 for display or other communication to a user. In at least one embodiment, context data for a user may also be stored to a user context data repository 522, which may include data about a user which may be useful as input to a network in generating inferences, or determining data to return to a user after obtaining instances. In at least one embodiment, relevant data, which may include at least some of input or inference data, may also be stored to a local database 534 for processing future requests. In at least one embodiment, a user can use account information or other information to access resources or functionality of a provider environment. In at least one embodiment, if permitted and available, user data may also be collected and ufsed to further train models, in order to provide more accurate inferences for future requests. In at least one embodiment, requests may be received through a user interface to a machine learning application 526 executing on client device 502, and results displayed through a same interface. A client device can include resources such as a processor 528 and memory 562 for generating a request and processing results or a response, as well as at least one data storage element 552 for storing data for machine learning application 526.

In at least one embodiment a processor 528 (or a processor of training module 512 or inference module 518) will be a central processing unit (CPU). As mentioned, however, resources in such environments can utilize GPUs to process data for at least certain types of requests. With thousands of cores, GPUs, such as PPU 400 are designed to handle substantial parallel workloads and, therefore, have become popular in deep learning for training neural networks and generating predictions. While use of GPUs for offline builds has enabled faster training of larger and more complex models, generating predictions offline implies that either request-time input features cannot be used or predictions must be generated for all permutations of features and stored in a lookup table to serve real-time requests. If a deep learning framework supports a CPU-mode and a model is small and simple enough to perform a feed-forward on a CPU with a reasonable latency, then a service on a CPU instance could host a model. In this case, training can be done offline on a GPU and inference done in real-time on a CPU. If a CPU approach is not viable, then a service can run on a GPU instance. Because GPUs have different performance and cost characteristics than CPUs, however, running a service that offloads a runtime algorithm to a GPU can require it to be designed differently from a CPU based service.

In at least one embodiment, video data can be provided from client device 502 for enhancement in provider environment 506. In at least one embodiment, video data can be processed for enhancement on client device 502. In at least one embodiment, video data may be streamed from a third party content provider 524 and enhanced by third party content provider 524, provider environment 506, or client device 502. In at least one embodiment, video data can be provided from client device 502 for use as training data in provider environment 506.

In at least one embodiment, supervised and/or unsupervised training can be performed by the client device 502 and/or the provider environment 506. In at least one embodiment, a set of training data 514 (e.g., classified or labeled data) is provided as input to function as training data. In at least one embodiment, training data can include instances of at least one type of object for which a neural network is to be trained, as well as information that identifies that type of object. In at least one embodiment, training data might include a set of images that each includes a representation of a type of object, where each image also includes, or is associated with, a label, metadata, classification, or other piece of information identifying a type of object represented in a respective image. Various other types of data may be used as training data as well, as may include text data, audio data, video data, and so on. In at least one embodiment, training data 514 is provided as training input to a training module 512. In at least one embodiment, training module 512 can be a system or service that includes hardware and software, such as one or more computing devices executing a training application, for training a neural network (or other model or algorithm, etc.). In at least one embodiment, training module 512 receives an instruction or request indicating a type of model to be used for training, in at least one embodiment, a model can be any appropriate statistical model, network, or algorithm useful for such purposes, as may include an artificial neural network, deep learning algorithm, learning classifier, Bayesian network, and so on. In at least one embodiment, training module 512 can select an initial model, or other untrained model, from an appropriate repository 516 and utilize training data 514 to train a model, thereby generating a trained model (e.g., trained deep neural network) that can be used to classify similar types of data, or generate other such inferences. In at least one embodiment where training data is not used, an appropriate initial model can still be selected for training on input data per training module 512.

In at least one embodiment, a model can be trained in a number of different ways, as may depend in part upon a type of model selected. In at least one embodiment, a machine learning algorithm can be provided with a set of training data, where a model is a model artifact created by a training process. In at least one embodiment, each instance of training data contains a correct answer (e.g., classification), which can be referred to as a target or target attribute. In at least one embodiment, a learning algorithm finds patterns in training data that map input data attributes to a target, an answer to be predicted, and a machine learning model is output that captures these patterns. In at least one embodiment, a machine learning model can then be used to obtain predictions on new data for which a target is not specified.

In at least one embodiment, training and inference manager 532 can select from a set of machine learning models including binary classification, multiclass classification, generative, and regression models. In at least one embodiment, a type of model to be used can depend at least in part upon a type of target to be predicted.

Example Streaming System

Figure 6:
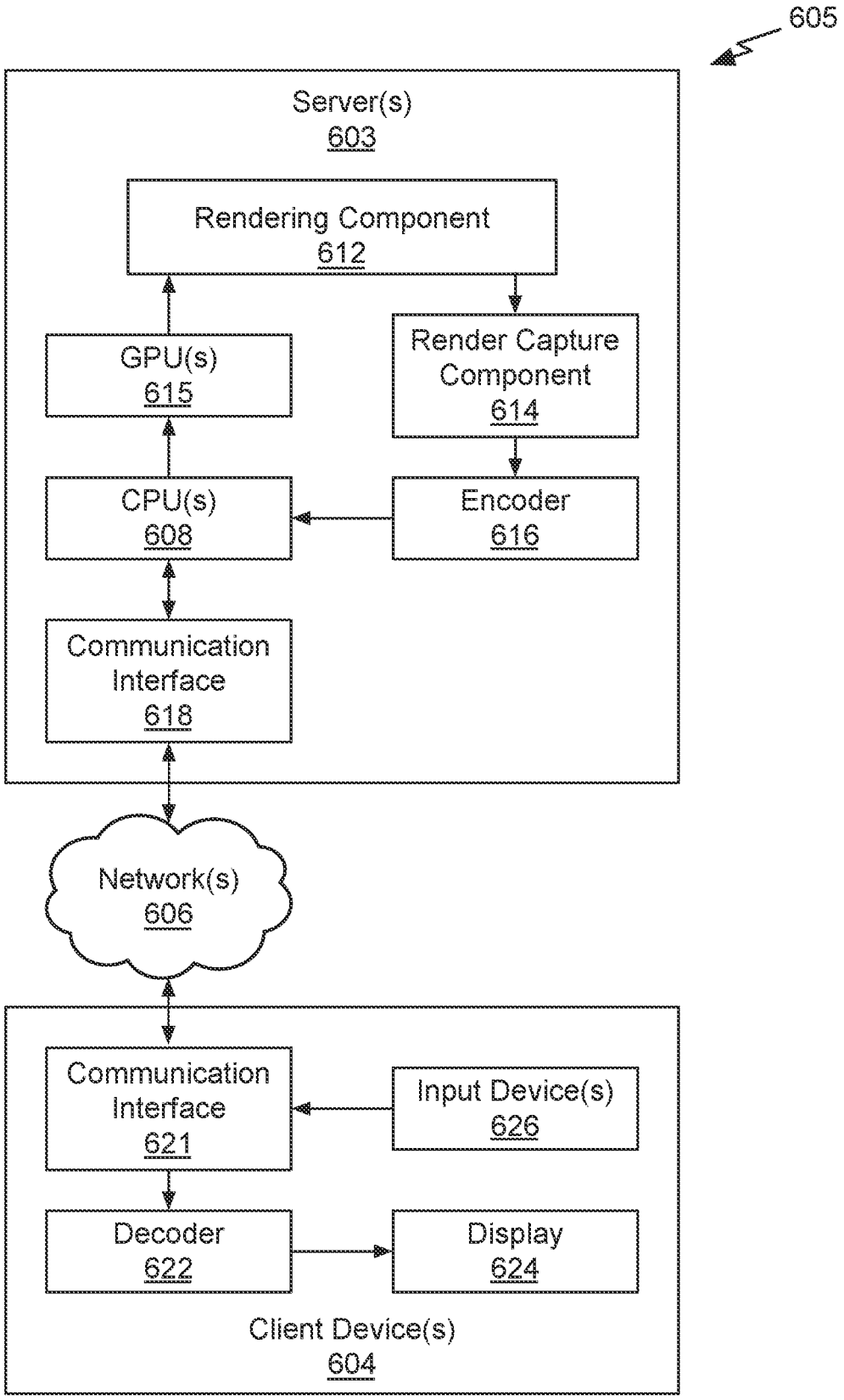
FIG. 6 illustrates an exemplary streaming system suitable for use in implementing some embodiments of the present disclosure.

FIG. 6 is an example system diagram for a streaming system 605, in accordance with some embodiments of the present disclosure. FIG. 6 includes server(s) 603 (which may include similar components, features, and/or functionality to the example processing system 500 of FIG. 5A and/or exemplary system 565 of FIG. 5B), client device(s) 604 (which may include similar components, features, and/or functionality to the example processing system 500 of FIG. 5A and/or exemplary system 565 of FIG. 5B), and network(s) 606 (which may be similar to the network(s) described herein). In some embodiments of the present disclosure, the system 605 may be implemented.

In an embodiment, the streaming system 605 is a game streaming system and the server(s) 603 are game server(s). In the system 605, for a game session, the client device(s) 604 may only receive input data in response to inputs to the input device(s) 626, transmit the input data to the server(s) 603, receive encoded display data from the server(s) 603, and display the display data on the display 624. As such, the more computationally intense computing and processing is offloaded to the server(s) 603 (e.g., rendering—in particular ray or path tracing—for graphical output of the game session is executed by the GPU(s) 615 of the server(s) 603). In other words, the game session is streamed to the client device(s) 604 from the server(s) 603, thereby reducing the requirements of the client device(s) 604 for graphics processing and rendering.

For example, with respect to an instantiation of a game session, a client device 604 may be displaying a frame of the game session on the display 624 based on receiving the display data from the server(s) 603. The client device 604 may receive an input to one of the input device(s) 626 and generate input data in response. The client device 604 may transmit the input data to the server(s) 603 via the communication interface 621 and over the network(s) 606 (e.g., the Internet), and the server(s) 603 may receive the input data via the communication interface 618. The CPU(s) 608 may receive the input data, process the input data, and transmit data to the GPU(s) 615 that causes the GPU(s) 615 to generate a rendering of the game session. For example, the input data may be representative of a movement of a character of the user in a game, firing a weapon, reloading, passing a ball, turning a vehicle, etc. The rendering component 612 may render the game session (e.g., representative of the result of the input data) and the render capture component 614 may capture the rendering of the game session as display data (e.g., as image data capturing the rendered frame of the game session). The rendering of the game session may include ray or path-traced lighting and/or shadow effects, computed using one or more parallel processing units—such as GPUs, which may further employ the use of one or more dedicated hardware accelerators or processing cores to perform ray or path-tracing techniques—of the server(s) 603. The encoder 616 may then encode the display data to generate encoded display data and the encoded display data may be transmitted to the client device 604 over the network(s) 606 via the communication interface 618. The client device 604 may receive the encoded display data via the communication interface 621 and the decoder 622 may decode the encoded display data to generate the display data. The client device 604 may then display the display data via the display 624.

It is noted that the techniques described herein may be embodied in executable instructions stored in a computer readable medium for use by or in connection with a processor-based instruction execution machine, system, apparatus, or device. It will be appreciated by those skilled in the art that, for some embodiments, various types of computer-readable media can be included for storing data. As used herein, a "computer-readable medium" includes one or more of any suitable media for storing the executable instructions of a computer program such that the instruction execution machine, system, apparatus, or device may read (or fetch) the instructions from the computer-readable medium and execute the instructions for carrying out the described embodiments. Suitable storage formats include one or more of an electronic, magnetic, optical, and electromagnetic format. A non-exhaustive list of conventional exemplary computer-readable medium includes: a portable computer diskette; a random-access memory (RAM); a read-only memory (ROM); an erasable programmable read only memory (EPROM); a flash memory device; and optical storage devices, including a portable compact disc (CD), a portable digital video disc (DVD), and the like.

It should be understood that the arrangement of components illustrated in the attached Figures are for illustrative purposes and that other arrangements are possible. For example, one or more of the elements described herein may be realized, in whole or in part, as an electronic hardware component. Other elements may be implemented in software, hardware, or a combination of software and hardware. Moreover, some or all of these other elements may be combined, some may be omitted altogether, and additional components may be added while still achieving the functionality described herein. Thus, the subject matter described herein may be embodied in many different variations, and all such variations are contemplated to be within the scope of the claims.

To facilitate an understanding of the subject matter described herein, many aspects are described in terms of sequences of actions. It will be recognized by those skilled in the art that the various actions may be performed by specialized circuits or circuitry, by program instructions being executed by one or more processors, or by a combination of both. The description herein of any sequence of actions is not intended to imply that the specific order described for performing that sequence must be followed. All methods described herein may be performed in any suitable order unless otherwise indicated herein or otherwise clearly contradicted by context.

The use of the terms "a" and "an" and "the" and similar references in the context of describing the subject matter (particularly in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. Furthermore, the foregoing description is for the purpose of illustration only, and not for the purpose of limitation, as the scope of protection sought is defined by the claims as set forth hereinafter together with any equivalents thereof. The use of any and all examples, or exemplary language (e.g., "such as") provided herein, is intended merely to better illustrate the subject matter and does not pose a limitation on the scope of the subject matter unless otherwise claimed. The use of the term "based on" and other like phrases indicating a condition for bringing about a result, both in the claims and in the written description, is not intended to foreclose any other conditions that bring about that result. No language in the specification should be construed as indicating any non-claimed element as essential to the practice of the invention as claimed.

What is claimed is:

1. A computer-implemented method for calibrating a linear voltage regulator, comprising:

coupling a first input of a comparator circuit to a second input of the comparator circuit;

adjusting a first offset input to the comparator circuit based on an output of the comparator circuit to cancel a first voltage offset associated with the first input and the second input;

decoupling the first input from the second input and coupling a reference voltage to the first input;

coupling a regulated voltage to the second input and operating the comparator circuit according to the first offset to generate a difference signal at the output; and based on the difference signal, adjusting a second offset input to an error amplifier circuit having a second voltage offset associated with a third input and a fourth input to cancel the second voltage offset while the error amplifier circuit generates a current control signal to adjust the regulated voltage at a load.

2. The computer-implemented method of claim 1, wherein the error amplifier circuit generates the current control signal to reduce differences between the reference voltage at the third input and the regulated voltage at the fourth input.

3. The computer-implemented method of claim 1, wherein adjusting the first offset input comprises equalizing a count of high logic levels and low logic levels at the output of the comparator circuit.

4. The computer-implemented method of claim 1, wherein adjusting the second offset input comprises equalizing a count of high logic levels and low logic levels at the output of the comparator circuit.

5. The computer-implemented method of claim 1, further comprising:

scaling the reference voltage to provide a scaled reference voltage at the third input; and scaling the regulated voltage to provide a scaled regulated voltage at the fourth input.

6. The computer-implemented method of claim 1, further comprising repeating the adjusting of the first offset input and the adjusting of the second offset input while the error amplifier circuit generates the current control signal.

7. The computer-implemented method of claim 1, wherein the linear voltage regulator is fabricated within an integrated circuit and the first offset input is adjusted through a off-chip interface.

8. The computer-implemented method of claim 1, wherein the linear voltage regulator is fabricated within an integrated circuit included in a server or in a data center to stream data to a user device.

9. The computer-implemented method of claim 1, wherein the linear voltage regulator is fabricated within an integrated circuit included within a cloud computing environment.

10. The computer-implemented method of claim 1, wherein the linear voltage regulator is fabricated within an integrated circuit used for at least one of training, testing, or certifying a neural network.

11. The computer-implemented method of claim 9, wherein the neural network comprises a neural network employed in at least one of a machine, a robot, or an autonomous vehicle.

12. A linear voltage regulator, comprising:

an error amplifier circuit having a first voltage offset associated with a first input and a second input, wherein the error amplifier circuit generates a current control signal to adjust a regulated voltage at a load while reducing differences between a reference voltage at the first input and the regulated voltage at the second input according to an offset cancellation input; and a comparator circuit having a second voltage offset associated with a third input and a fourth input, wherein the comparator circuit generates the offset cancellation input according to a calibration of the first voltage offset and a calibration of the second voltage offset.

13. The linear voltage regulator of claim 12, wherein the second voltage offset is calibrated when the third input is coupled to the fourth input.

14. The linear voltage regulator of claim 12, wherein the first voltage offset is calibrated, after the second voltage offset is cancelled, and while the reference voltage is coupled to the third input and the regulated voltage is coupled to the fourth input.

15. The linear voltage regulator of claim 12, wherein the offset cancellation input is adjusted until the comparator circuit determines that the third input and the fourth input are equal.

16. The linear voltage regulator of claim 12, further comprising repeating calibration of the first voltage offset while the error amplifier circuit generates the current control signal.

17. A linear voltage regulator, comprising:

a transistor coupled between a power supply and a load to generate a regulated voltage at the load controlled by a current control signal at a gate of the transistor;

an error amplifier circuit having a first voltage offset associated with a first input and a second input that is configured to generate the current control signal, according to an offset cancellation input, to reduce differences between a reference voltage at the first input and the regulated voltage at the second input; and a comparator circuit configured to determine a second voltage offset when a third input and a fourth input to the comparator circuit are coupled together and adjust the offset cancellation input to cancel the first voltage offset when the third input is coupled to the reference voltage and the fourth input is coupled to the regulated voltage.

18. The linear voltage regulator of claim 17, wherein at least one of the first voltage offset or the second voltage offset varies with temperature.

19. The linear voltage regulator of claim 17, wherein the comparator circuit is configured to periodically adjust the offset cancellation input while the error amplifier circuit operates to reduce the differences between the reference voltage and the regulated voltage.

20. The linear voltage regulator of claim 17, wherein the comparator circuit is configured to periodically adjust the second voltage offset while the error amplifier circuit operates to reduce the differences between the reference voltage and the regulated voltage.

* * * * *